US005240012A

United States Patent [19]

Ehrman et al.

[11] Patent Number: 5,240,012

[45] Date of Patent: Aug. 31, 1993

[54] CARBON HEAT SMOKING ARTICLE WITH REUSABLE BODY

[75] Inventors: Jim M. Ehrman, Sacksville, Canada; Clifford H. Goldsmith, New York, N.Y.; Everett C. Grollimund, Midlothian, Va.; Harry V. Lanzillotti, Blacksburg, Va.; A. Clifton Lilly, Jr., Chesterfield, Va.

[73] Assignee: Philip Morris Incorporated, New York, N.Y.

[21] Appl. No.: 792,012

[22] Filed: Nov. 13, 1991

[51] Int. Cl.[5] ..... A24F 1/22

[52] U.S. Cl. ..... 131/194; 131/182

[58] Field of Search ..... 131/194, 195, 196, 197, 131/182, 183

[56] References Cited

U.S. PATENT DOCUMENTS 4,793,365 12/1988 Sensabaugh, Jr. et al. ..... 131/194

*Primary Examiner*—V. Millin

*Assistant Examiner*—William M. Pierce

[57] ABSTRACT

A smoking article that produces no visible sidestream smoke in which at least the carbon heat source and the tobacco flavor producing elements can be ejected from a reusable body of the smoking article.

44 Claims, 12 Drawing Sheets

CARBON HEAT SMOKING ARTICLE WITH REUSABLE BODY

FIELD OF THE INVENTION

The present invention relates to the field of smoking articles that produce no visible sidestream smoke More specifically, the present invention relates to smoking articles that produce no visible sidestream smoke and have the capability to eject at least the heat source and tobacco flavor producing element from the reusable body of the smoking articles when desired.

BACKGROUND OF THE INVENTION

In the past, there have been attempts to produce smoking articles that provide aerosol or vapors for inhalation rather than conventional smoke. For example, there are smoking articles which have a charcoal rod with a separate carrier impregnated with flavorants and a synthetic "smoke" forming agent. The charcoal rod is coated with a concentrated sugar solution that forms an impervious layer during burning. The coating layer is intended to contain the gases formed during smoking and concentrate the heat the rod generates.

Another example are smoking articles which burn tobacco, as in a conventional cigarette, to heat a metallic cylinder. The metal cylinder contains a source of nicotine (such as reconstituted tobacco or tobacco extract). During smoking, the material inside the metal cylinder releases vapors that mix with air inhaled through an open end of the associated tube. This tube extends to the burning end of the smoking article. Smoking articles similar to the one just described include a tube which becomes frangible upon heating so that it will break off and not protrude as the surrounding tobacco burns.

Yet another example is smoking articles that produce a nicotine-containing aerosol by heating a flavor generator. Hot gases which result from the combustion of a fuel rod or other carbonaceous material heat the flavor generator. A variation of these smoking articles uses a short fuel element. The performance of these smoking articles is improved by maximizing heat transfer between the fuel element and the aerosol generator. A spun glass fiber insulator provides insulation to the fuel element and aerosol generator assembly. Heat transfer is effected by a metallic conductor between the fuel element and flavor generator to conduct heat, and by using the insulation to minimize heat loss.

The smoking articles containing the spun glass fiber insulator have several drawbacks. First, the resilient glass fiber insulating jacket is difficult to handle on modern mass production machinery. Second, the glass fibers may become dislodged during shipping and migrate through the pack to rest on the mouth end of the articles which gives rise to potential inhalation of glass fibers by the smoker. Third, the metallic heat conductor may itself absorb much of the heat produced by the fuel element and not transfer it as required.

The present invention overcomes the problems associated with prior smoking articles that produce no visible sidestream smoke. Moveover, the smoking articles in the prior art do not have the features of the smoking article of the present invention, such as a smoking article that includes an active element and reusable body, with the reusable body having means to eject therefrom at least the heat source and tobacco flavor producing elements of the active element.

SUMMARY OF THE INVENTION

The present invention is a smoking article that produces no visible sidestream smoke. The article has the basic appearance of a conventional cigarette. The preferred embodiment of the smoking article comprises an active element, which includes a sleeve, end cap, heat source, and tobacco flavor producing elements; and a reusable body, which includes a holder, ejector section, mouthpiece section. The active element is detachably fixed to the reusable body to form the smoking article of the present invention. The reusable body can be used with a number of active elements before it must be replaced.

The sleeve of the active element includes main and second hollow, cylindrical members. The main hollow, cylindrical member has a non-combustible internal wall. If desired, the outside diameter of the main hollow, cylindrical member can be covered with an overwrap even though it is not contemplated in the preferred embodiment. The inside diameter of the main hollow, cylindrical member has a heat reflective material disposed on it. Within the main hollow, cylindrical member is the second hollow, cylindrical member. The second hollow, cylindrical member extends a portion of the length of the main hollow, cylindrical member. The second hollow, cylindrical member has heat reflective material disposed at its exterior and interior surfaces.

One end of the second hollow, cylindrical member has means to suspend the heat source within it and, thereby within the sleeve in general. The inside diameter of the second hollow, cylindrical member, and the first and second circular walls disposed across its inside diameter spaced away from each other form a chamber for receiving the tobacco flavor producing elements. The main and second hollow, cylindrical members extend rearward of the second circular wall a predetermined distance to form the end of the sleeve which is also the second end of the active element.

The reusable body comprises an elongated holder, ejector section, and a mouthpiece section. The ejector section is translatable with respect to the holder. The mouthpiece section is disposed at a second end of the holder and forms the second end of the reusable body. The portion of the mouthpiece section that is received by the second end of the holder has biasing means which improves the interference fit between the holder and mouthpiece section.

The end of the holder that is intended to receive the active element has a connector member extending from it. The connector member has an outside diameter slightly less than the inside diameter of the second end of the active element so that the active element fits snugly over the connector member with an interference fit. The end of the ejector section abuts at least a portion of the end of the active element sleeve.

When the heat source is spent or the smoker simply desires to discard at least the heat source and tobacco flavor producing elements of the active element, the ejector section is translated with respect to the holder toward the active element. This causes the end of the ejector section to contact at least a portion of the end of the sleeve, and at least the heat source and the tobacco flavor producing elements are ejected from the reusable body when the ejector section has moved a predetermined distance.

The smoking article is reassembled by connecting an active element to the reusable body that has at least a new heat source and new tobacco flavor producing elements. When this active element is connected to the reusable body, the ejector section is moved to its original position before being used to eject the spent heat source and tobacco flavor producing elements.

An object of the present invention is to provide a smoking article that includes an active element and a reusable body, produces no visible sidestream smoke, has the general appearance of a conventional cigarette, and gives the sensations associated with smoking tobacco, with the reusable body having means to eject therefrom at least the heat source and tobacco flavor producing elements of the active element.

This and other objects of the invention will be described in greater detail in the remainder of the specification.

DETAILED DESCRIPTION OF THE DRAWINGS

The present invention is a smoking article that has the general appearance of a conventional cigarette. The smoking article comprises an active element and a reusable body. The smoking article produces no visible sidestream smoke and at least its heat source and tobacco flavor producing elements of its active element may be ejected from the reusable body when desired.

Figure 1:
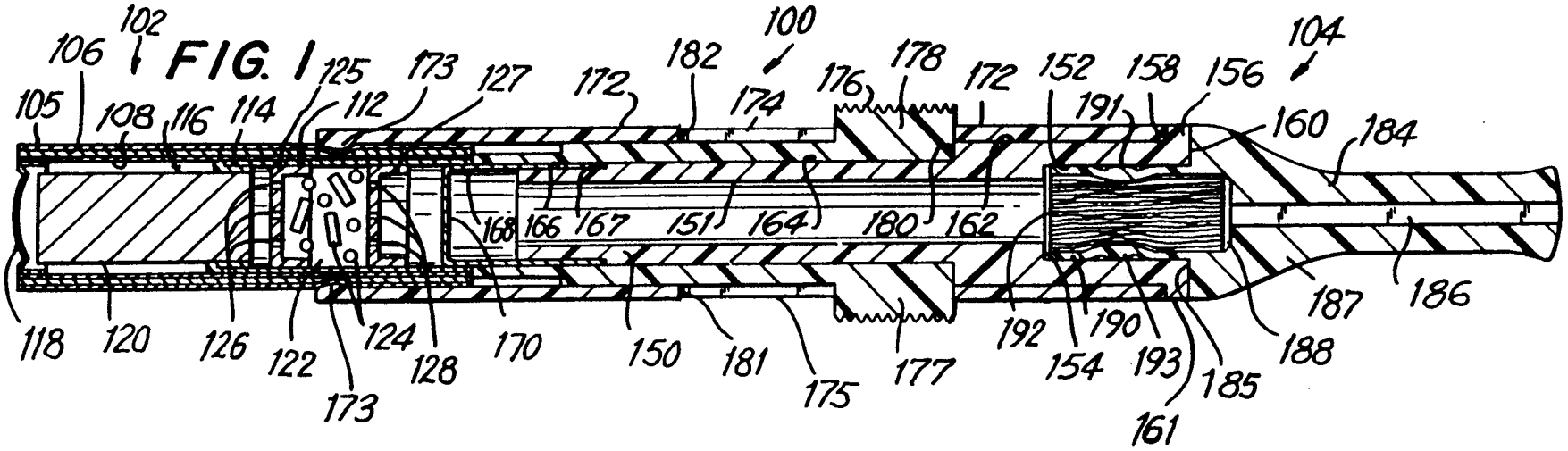
FIG. 1 is a cross-sectional view of the preferred embodiment of the smoking article of the present invention.
Figure 2:
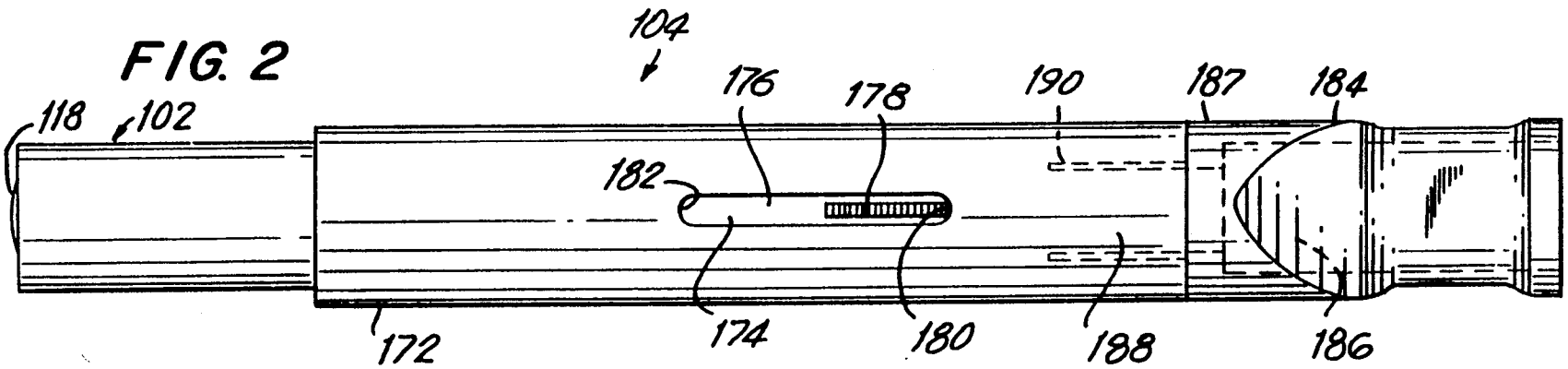
FIG. 2 is a top perspective view of the preferred embodiment of the smoking article of the present invention with the interior opening of the mouthpiece section shown in phantom.
Figure 3:
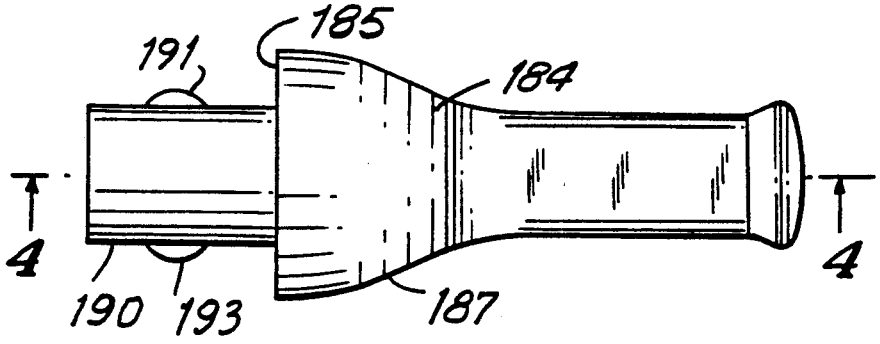
FIG. 3 is a side perspective view of the mouthpiece section of the preferred embodiment of the smoking article of the present invention.
Figure 4:
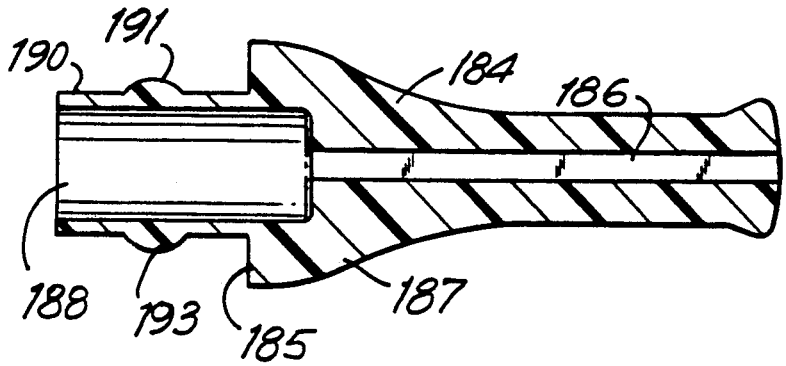
FIG. 4 is a cross-sectional view of the mouthpiece section along 4—4 of FIG. 3.
Figure 5:
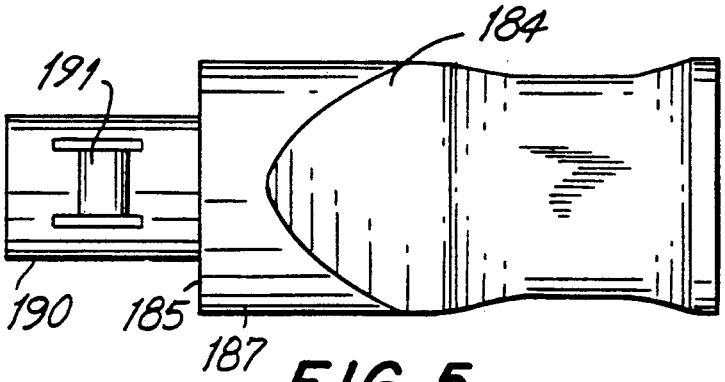
FIG. 5 is a top perspective view of the mouthpiece section of the preferred embodiment of the smoking article of the present invention.
Figure 6:
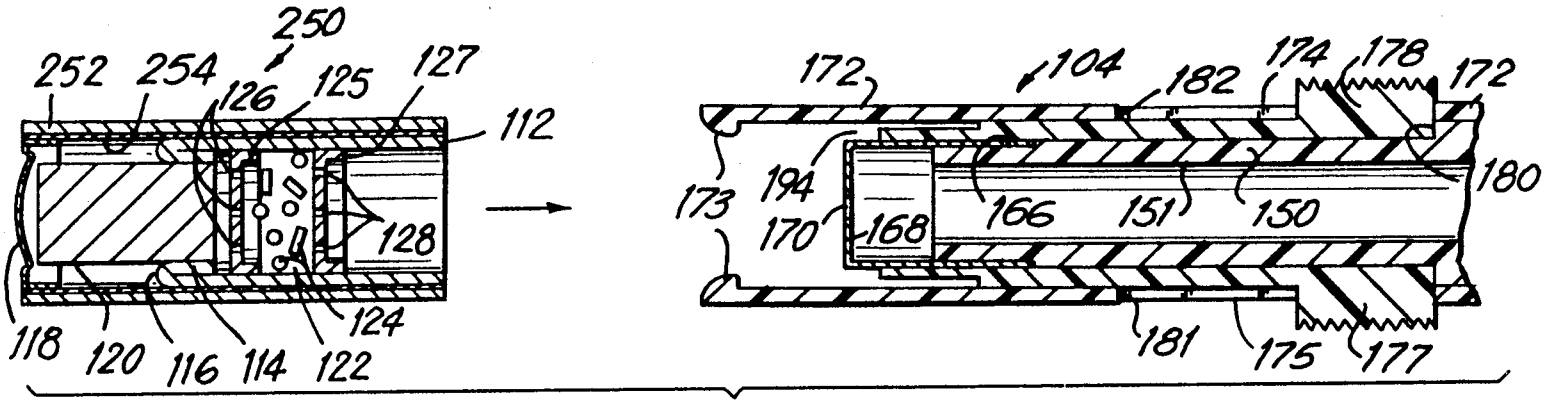
FIG. 6 is an exploded, cross-sectional view of a further embodiment of the active element of the preferred embodiment of the smoking article of the present invention and the end of the reusable body that receives the active element.
Figure 7:
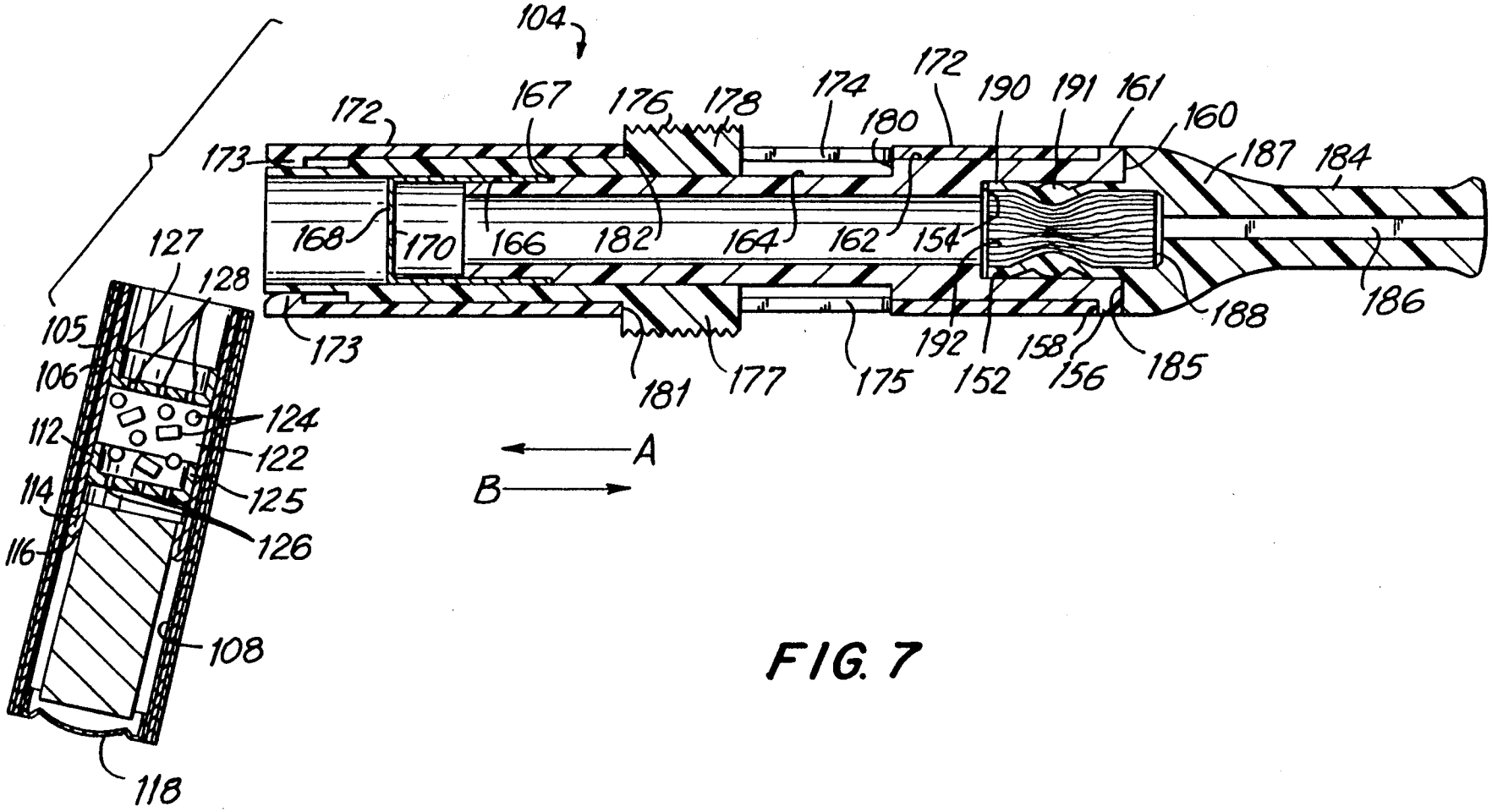
FIG. 7 shows the method of ejecting the active element from the reusable body in the preferred embodiment of the smoking article of the present invention.

FIGS. 1–7 show the preferred embodiment of the smoking article of the present invention. FIG. 1 shows the smoking article 100 assembled. FIG. 2 shows a top perspective view of smoking article 100 shown in FIG. 1. FIGS. 3, 4, and 5 show views of the mouthpiece section. FIG. 6 shows a further embodiment of the active element of smoking article 100. FIG. 7 shows the active element being ejected from the reusable body of smoking article 100.

Referring to FIG. 1, smoking article 100 comprises two sections: disposable, detachable front end 102 and reusable body 104. The front end is referred to as the "active element" because it produces the tobacco flavored hot vapors or aerosol that is drawn through the reusable body and inhaled by the smoker. The vapors or aerosol, when inhaled, provide the smoker with the sensations of smoking tobacco.

Active element 102 comprises treated outer wrap 105 and treated inner wrap 106, perforated foil 108 disposed at the inside diameter of inner wrap 106, laminate tube 112, heat source 120, first circular wall 125 with holes 126 therethrough, tobacco flavor producing elements 124 in chamber 122, and second circular wall 127 with holes 128 therethrough. Laminate tube 112 is secured with an interference fit within the combination of outer wrap 105 and inner wrap 106, with perforated foil 108. Laminate tube 112 extends approximately two-thirds ($\frac{2}{3}$) the length of the combination starting from the combination's second end. The second end of the combination is the one that connects to reusable body 104. The combination of outer wrap 105, inner wrap 106, perforated foil 108, and laminate tube 112 form the sleeve of active element 102.

Heat source 120 is secured in turned-in end 114 of laminate tube 112. First circular wall 125 is inserted in the open, opposite end of laminate tube 112 spaced away from the end of heat source secured in the turned-in end. Second circular wall 127 is also inserted in the open end of laminate tube 112. The second circular wall is spaced away from the first circular wall and is disposed about one-half ($\frac{1}{2}$) way along longitudinal length of the laminate tube. The volume within laminate tube 112 between first circular wall 125 and second circular wall 127 is chamber 122 which is filled with tobacco pellets 124. The tobacco pellets are the tobacco flavor producing elements for the smoking article. When the pellets are heated by air drawn through, and hot gases from, heat source 120, they produce the tobacco flavored vapors or aerosol that the smoker inhales and from which the smoker receives the sensations of smoking tobacco.

End cap 118 is inserted in the first end of the combination of outer wrap 105, inner wrap 106, and perforated foil 108 (which is remote from the end that connects to reusable body 104). The end cap is secured to the end by crimping. End cap 118 is air permeable and has a heat reflective interior surface. The end cap also prevents the possibility of ash falling from the active element when the smoking article is being smoked.

Having now described the basic structure of active element 102, the various component parts will described in greater detail.

The combination of outer wrap 105, inner wrap 106, and perforated foil 108 is a radiant energy reflector. The combination reflects the radiant energy to keep the heat generated by the heat source within the active element.

The outer and inner wraps are treated, for example, with flame retardant materials, such as phosphates, which have high latent heat and give them the ability to absorb escaping heat. Heat is absorbed also by the latent heat of pyrolysis of the paper layers themselves. Ideally, under normal smoking conditions, the treated outer and inner wraps will not ignite and the overwrap will not darken. The combination outer wrap 105 and inner wrap 106 of active element 102 is air permeable.

Perforated foil 108 is preferably made from standard 0.0015 in. aluminum foil which is embossed to provide raised holes. The foil is calendared to flatten the holes so the resultant foil is relatively smooth. The desired permeability for the foil is 4% to 12% open area. The perforated foil serves as a good reflector of the heat generated by the heat source, thereby keeping such heat within the active element.

Laminate tube 112 is made from strips of material. The strips comprise an outer aluminum foil layer, intermediate paper layers, and an inner aluminum foil layer. The foil is as thin as possible so it will retain as little heat as possible. The strips are spiral wound into a tubular structure. The structure has aluminum presented at the outside and inside diameter. The intermediate paper layers include up to three layers of treated paper to reduce thermal degradation. These layers are treated, for example, with magnesium hydroxide, calcium carbonate oxide, or other refractory type material.

Once formed into a tube, the end is folded inwardly to form turned-in end 114 with end lip 116. Turned-in end 114 secures the heat source in the laminate tube with an interference fit.

Laminate tube 112 has reflective inside and outside diameters. The inside diameter reflects the heat to keep it within laminate tube 112 for maximum flavor generation from the tobacco pellets within chamber 122. The outside diameter helps reflect heat which may be conducted back along the outside diameter. This is caused by contact between heat source and the material at the outside surface since the heat source is held in place by the turned-in end. The outside diameter also reflects heat conducted back along perforated foil 108. These actions protect the insulating paper from thermal decomposition and dissipates heat.

As stated, laminate tube 112 extends forward from the second end of the combination of outer wrap 105, inner wrap 106, and perforated foil 108 approximately two-thirds ($\frac{2}{3}$) the longitudinal length of the combination. When laminate tube is so disposed, it fixes within the combination the remainder of the active element, viz., heat source 120, tobacco pellets 124, first circular wall 125 and circular wall 126. Laminate tube 112 preferably is not air permeable because tobacco pellets 124 in chamber 122 are kept oxygen-deprived to prevent them from igniting. If they did ignite, thermal decomposition constituents may enter the aerosol causing off tastes to be delivered to the smoker.

As seen in FIG. 1, heat source 120 is suspended in the first end of the combination of outer wrap 105, inner wrap 106, and perforated foil 108 by turned-in end 114 of laminate tube 112 in which it is secured. The annular space around heat source 120 allows air permeated through the combination of the outer wrap, inner wrap, and perforated foil, and air passing through the openings in end cap 118 to be supplied to the heat source for sustained combustion. Moreover, heat loss to the outside is minimized by the insulating value of the air in the annular space around heat source 120, and reflection of the radiant heat by foil 108 and the interior surface of end cap 118.

Heat source 120 may be formed from charcoal and may have at least one longitudinal passageway extending through it. Preferably, the cross-sectional shape of the passageway is a multi-pointed star. The star has a small circular center body with long narrow points extending radially outward from it. Heat source 120 may have a void volume greater than about 50% with a pore size between the charcoal particles of about 1–2 microns. The heat source may weigh about 80–100 mg have a density in the range 0.2–1.5 g/cc. The BET surface area of the constituent charcoal particles is in the range of about 50–2000 $m^2/g$. It is to be understood that other types of heat sources may be used in place of the preferred heat source and still be within the scope of the present invention.

Tobacco pellets 124 in chamber 122 are formed by combining in an extruder particularized tobacco with a size in the range of about 20–400 mesh, an aerosol precursor, and finely divided filler material. The precursor can be of any type that will disburse widely among the tobacco particles, for example, glycerine, 1,3-butanediol or propylene glycol. The filler material increases the thermal load to prevent the hot gases from raising the temperature of the pellets above their thermal decomposition temperature. Filler materials useful for this purpose are calcium carbonate and alumina.

The mixture is extruded into spaghetti-like strands of approximately the same diameter. The strands are them cut into pellets having uniform lengths. The pellets, preferably, have uniform dimensions with a composition of about 15%–95% tobacco material, about 5%–35% aerosol precursor, and about 0%–50% filler material. It is to be understood that other types of tobacco flavor producing material may be used and still be within the scope of the present invention.

End cap 118 is reflective to maintain the heat generated by heat source 120 within active element 102. It also keeps any ash that forms during burning of the heat source within active element 102. End cap 118 is positioned at the first end of the combination of outer wrap 105, inner wrap 106, and perforated foil 108. The cap has at least one opening to allow the ingress of air.

In the preferred embodiment, there are six openings equally spaced about the periphery of the cap. The openings are approximately 0.080 in. in diameter. With sufficient oxygen, heat source 120 will burn producing mostly carbon dioxide. The hot air that has passed through the star-shaped passageway in the heat source and hot gases from the heat source flow through chamber 122 containing tobacco pellets 124. The mixture flowing through the chamber has a reduced oxygen content so the tobacco pellets in the chamber undergo pyrolysis and not combustion even if their temperature were high enough to ignite them otherwise. Hence, there is substantially no sidestream smoke when smoking article 100 is used.

Referring to FIG. 1, reusable body 104 will be described. Reusable body 104 comprises holder 150, connector member 168, mouthpiece section 184, ejector section 176, and slotted tubular cover 172. Filter 192 is optional.

Hollow, cylindrical holder 150 has stepped inside and outside diameters. The holder is preferably formed from moldable, heat resistant plastic. The tubular member also may be formed from laminate foil/paper strips spiral wound into a tubular member, with foil at the inside diameter. The tubular member is then pressed in any conventional manner to achieve the desired steps at the inside and outside diameters.

The inside diameter has two steps. First step 151 is elongated and has a first diameter. It extends from the first end of holder 150 approximately four-fifths (4/5) the longitudinal length of the holder. Second step 152 having a second, larger diameter extends the remaining one-fifth (1/5) of the longitudinal length of holder 150 to the second end of holder 150. Annular ledge 154 is formed between first step 151 and second step 152.

The outside diameter of holder 150 has four steps. The steps increase in diameter from the first end to the second end. First step 166 having a first diameter extends from the first end approximately one-sixth (1/6) the longitudinal length of holder 150.

Second step 164 with a second diameter, which is only slightly larger than the diameter at first step 166, extends from the first step approximately one-half (½) the longitudinal length of the holder. Hence, second step 164 ends at a point two-thirds (⅔) the longitudinal length of the holder from the first end. Annular ledge 167 is formed between first step 166 and second step 164.

Third step 162 with a third diameter larger that is than that of second step 164 extends slightly less than the remaining one-third (⅓) of the longitudinal length of holder 150 to the second end. Annular ledge 180 is formed between second step 164 and third step 162.

Fourth step 161 with a fourth diameter, which is larger than that of third step 162, extends the short distance to the second end of the holder. Annular ledge 158 is formed between fourth step 161 and third step 162. Annular ledge 158 and surface 160 at the second end of holder 150 form flange 156.

Connector member 168 is a short, hollow, cylindrical member with one closed end. Its inside diameter is slightly larger than the diameter of first step 166 at the outside diameter of holder 150. The open end of connector member 168 is disposed on, and secured to, first step 166 with its open end edge abutting annular ledge 167. The difference in the diameter between first step 166 and second step 164 is the same as the wall thickness of connector member 168. Hence, when connector member 168 is disposed on first step 166, the outside diameter is the same as that of second step 164.

The closed end of connector member 168 has orifice 170 disposed therethrough. Orifice 170 causes hot vapors and gases produced by active element 102 to increase in velocity and expand as they enter holder 150. The expansion cools the saturated vapors to stabilize the aerosol. This minimizes condensation in the mouthpiece section and increases the delivery of aerosol to the smoker. The desired expansion and resultant cooling of the vapors are, thereby, controlled by the size of the orifice.

In an alternative configuration of the preferred embodiment of the smoking article, connector member 168 does not have to be a separate member secured to first step 166 of holder 150, as shown in FIG. 1. In this alternative configuration, there is no first step 166 at the outside diameter of holder 150; second step 164 extends to the first end of holder 150. It is contemplated that a separate member that includes orifice 170 be disposed within holder 150 transverse to the longitudinal axis, spaced away from the first end of holder 150.

In a further alternative configuration of the preferred embodiment of the smoking article, connector member 168 is secured in, but spaced away from, the second end of active element 102. In this configuration, the first end of holder 150 extends to the where the closed end of connector member 168 is shown in FIG. 3. This extension has an outside diameter equal to that of second step 164.

Referring to FIGS. 1 and 2, slotted tubular cover 172 is disposed on, and secured to, third step 162 at the outside diameter of holder 150. Slotted tubular cover 172 is preferably formed from moldable heat resistant plastic. Slotted tubular cover also can be conventionally constructed from laminate paper strips that are spiral wound into a tubular member that then has the slots punched in it.

Slotted tubular cover 172 extends from annular ledge 158 a predetermined distance past the end of connector member 168 that extends from the end of holder 150. Slotted tubular cover 172 has opposing slots 174 and 175. The slotted tubular cover has slots 174 and 175 for receiving therethrough portions of ejector section 176. The slots are used in conjunction with ejector section 176, as will be discussed subsequently.

When slotted tubular cover 172 is disposed on third step 162, the slots extend a predetermined distance from annular ledge 180 toward the first end of holder 150. The inside diameter of slotted tubular cover 172, and the outside diameter of holder 150 at second step 164 and the outside diameter of connector member 168, form deep annular opening 194.

Referring to FIGS. 1, 5, and 6, slotted tubular cover 172 has raised members 173 disposed at the inside diameter of the first end. These members engage the outside diameter of active element 102. The members enhance the strength of the interference fit between the slotted tubular cover and the active element.

FIGS. 1, 5, and 6 show only two of the four raised members equidistantly spaced around the inside diameter at the first end. Even though the preferred embodiment includes only four raised members disposed at the inside diameter of the first end of slotted tubular cover 172, a greater or lesser number of raised members can be disposed there and still within the scope of the present invention. Moreover, it is still within the scope of the invention to have a slotted tubular cover that does not include any raised members.

Each raised member is an elongated bump that tapers for its thickest cross-section, which is at a position spaced a short distance from the first end of the slotted tubular cover, down to its thinnest cross-section, which is adjacent the first end. The raised members are elongated in the direction of the longitudinal axis of the slotted tubular cover. Even though the raised members are described as being bumps elongated in the direction of the longitudinal axis of slotted tubular cover, the raised members can have other shapes and still be within the scope of the invention.

Again referring to FIGS. 1 and 2, ejector section 176 is tubular and disposed in annular opening 194. Ejector section 176 is translatable over the outside diameter of second step 164 of holder 150 and the outside diameter of connector member 168. When the second end of ejector section 176 abuts annular ledge 180, the first end extends to a position within annular opening 194 just short of the end of connector member 168.

Ejector section 176 has gripping members 177 and 178 that extend radially outward from positions near the second end. The top surfaces of the gripping members have a sawtooth pattern disposed in them to facilitate non-slip engagement.

The height of the gripping members in the outward radial direction is sufficient as long as slots 174 and 175 in the slotted tubular cover act as stops for the translatable movement of the gripping members in the longitudinal direction of holder 150. The longitudinal lengths of gripping members 177 and 178, and the length of slots 174 and 175 through which they extend, respectively, are such that when the gripping members are in their forward most positions in the respective slots, the first end of the ejector section is at least in the same plane as the first end of the slotted tubular cover. However, the end of ejector section 176 can extend past the end of slotted tubular cover 172 and still be within the scope of the invention. And, when the gripping members are in their rearward most positions in their respective slots, the first end of the ejector section is retracted within deep annular opening 194. It is understood that only one gripping member may be used and still be within the scope of the invention.

Referring to FIGS. 1, 2, 3, 4, and 5, mouthpiece section 184 will be described. Mouthpiece section 184 connects to the second end of holder 150. In preferred embodiment, mouthpiece section 184 includes main segment 187, and hollow, cylindrical segment 190. The hollow, cylindrical segment extends forward from annular ledge 185 to form the first end of the mouthpiece section. The main segment of mouthpiece section 184 tapers from a circular cross-section equal in the diameter of annular flange 156 to the rectangular cross-section at the second end of the mouthpiece section. The exterior of the mouthpiece section adjacent the second end widens slightly to facilitate being held in the mouth of the smoker.

Hollow, cylindrical segment 190 has a circular cross-sectional shape near annular ledge 185 and the distal end that forms the first end. Near the center, it has a circular cross-sectional shape with bumps 191 and 193 that extending radially outward from the outside diameter. Without considering the bumps, the hollow, cylindrical segment has an outside diameter slightly less than the diameter at second step 152 at the inside diameter of holder 150.

The bumps are shown disposed from opposite sides of the outside diameter of the hollow, cylindrical segment. Each bump has longitudinally extending slits disposed along its sides. The slits are slightly longer than the bumps. The slits allow movement of the bumps in the radially inward direction when urged in that direction.

Mouthpiece section 184 connects to holder 150 by inserting hollow, cylindrical segment 190 into the second end of holder 150. The connection is an interference fit. When fully inserted, annular ledge 185 of the mouthpiece section abuts end surface 160 at the second end of the holder.

When mouthpiece section 184 is connected to holder 150, the bumps are urged in the radially inward direction. Since the material the mouthpiece section is made from has some resiliency, the bumps are biased in the radially outward direction when urged inwardly which enhances the strength of the interference fit.

The preferred embodiment of the mouthpiece section includes bumps 191 and 193 which, as stated, strengthen the interference fit between the mouth piece section and the holder. However, a mouthpiece section without such bumps is within the scope of the invention.

The two-part opening within mouthpiece section 184 comprises cylindrical opening 188, which extends from the first end of the mouthpiece section rearward through hollow, cylindrical segment 190 and partially into main segment 187, and rectangular opening 186, which extends through the remainder of the main segment. Rectangular opening 186 is best seen FIGS. 1 and 2.

If the smoker desires, replaceable plug wrap covered cellulose acetate filter 192 may be disposed in cylindrical opening 188 of mouthpiece section 184. Annular ledge 154 between the first and second steps at the inside diameter of holder 150 acts as a stop to keep the filter within cylindrical opening 188.

The exterior of the preferred embodiment of mouthpiece section 184 is formed by the outside shapes of hollow, cylindrical segment 190, with bumps 191 and 193, and tapering main segment 187. And, the interior is defined by the two-part opening. It is contemplated also that the mouthpiece section can have other interior and exterior shapes and still within the scope of the present invention. For example, mouthpiece section 184 may comprise the hollow, cylindrical segment, with bumps that are substantially the same as those disposed on segment 190 of the preferred embodiment, and a main segment may also be a hollow, cylindrical member with an outside diameter equal to the diameter of annular flange 156 of holder 150. In this alternative configuration, an annular flange is formed between the cylindrical and main segments. The inside diameter of this configuration of the mouthpiece section can be stepped, as in the preferred embodiment, or can be a single diameter. In either case, however, if desired, a replaceable filter can be disposed in an opening of the mouthpiece section.

FIG. 6 shows a further embodiment of the active element. In this figure, the active element is spaced away from the end of reusable body 104. Active element 250 is the same as active element 102 except that the combination of outer wrap 105 and inner wrap 106 is replaced by a ceramic member 252. The ceramic member is air permeable like the combination of outer wrap 105 and inner wrap 106. Ceramic member 252 may have perforated foil 254 disposed at the inside diameter. The perforated foil, as in the preferred embodiment, is air permeable and useful for reflecting heat. Ceramic member 252 with perforated foil 254 disposed at the inside diameter, like the combination of outer wrap 105 and inner wrap 106, and perforated foil 108, is a radiant energy reflector.

Ceramic member 252 is preferably formed from ceramic material that is non-combustible, inexpensive, lightweight, porous, and possesses sufficient strength when fabricated into ceramic member 252 to withstand crushing loads and other forces applied during high speed assembly operations on modern mass production machinery. It can be fabricated using conventional ceramic processing methods that are adjusted so that the resultant ceramic member has the desired properties. Ceramic member 252 has a density between about 1.1-2.0 g/cc, and porosity between about 40%-60%. The particle size of the ceramic material is between 0.5 and 100 microns. Preferably, the ceramic material has a density of about 1.3 g/cc, porosity of about 50%, and particle size of about 35 microns.

One preferred ceramic material is cordierite, which is a known ceramic material comprising magnesium, silicon and aluminum. In addition to cordierite, other suitable ceramic materials include mullite, alumina and zirconia.

Referring to FIGS. 1, 2, and 7, the method of ejecting active element 102 from reusable body 104 will be described. After heat source 120 is spent, the smoker usually desires to discard active element 102 so that it can be replaced with a new one. Smoking article 100 with spent active element 120 would appear as shown in FIG. 1 except portions of the heat source would have been turned to ash.

To replace spent active element 102, the smoker may grasp slotted tubular cover 172 near the second end of the holder with the fingers and thumb of one hand and would place a finger and the thumb of the other hand on gripping members 177 and 178 of ejector section 176 extending through slots 175 and 174, respectively. The smoker would then push the gripping members, and, thereby the ejector section in direction "A" in FIG. 7. As this is done, the first end of ejector section 176 pushes the second end of active element 102 adjacent it in the same direction. The active element is pushed in that direction until gripping members 177 and 178 reach the opposite ends of slots 175 and 174. That is, until the gripping members contact forward edges 181 and 182 of the respective slots, as shown.

When the gripping members reach the opposite ends of the slots, the first end of ejector section 176 will have moved the second end of active element from over connector member 168, pushing it clear of the confines of the first end of slotted tubular cover 172. Active element 102 then falls away from reusable body 104, as shown in FIG. 7.

After the active element is ejected, gripping members 177 and 178 are pushed in direction "B" in FIG. 7 until they reach the opposite end of slots 175 and 174. This moves ejector section 176 back to its original position. The reusable body is ready to receive another active element. Ejector section 176 can also be reset to its original position by detachably fixing the next active element to the reusable body.

Figure 8:
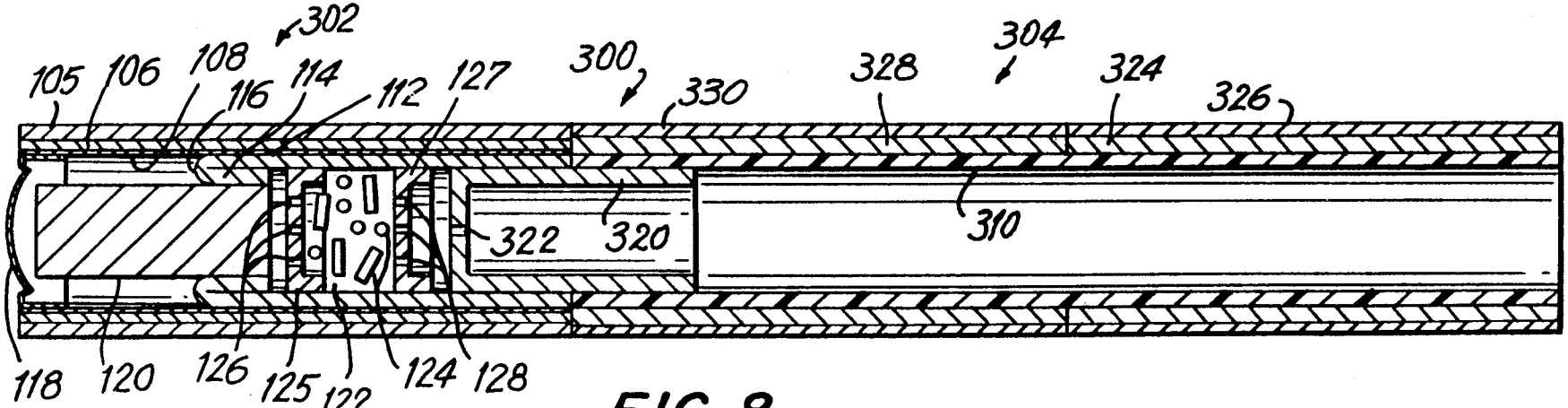
FIG. 8 is a cross-sectional view of the second embodiment of the smoking article of the present invention.

FIG. 8 is directed to the second embodiment of the smoking article of the present invention. Smoking article 300 comprises active element 302 and reusable body 304. Active element 302 is the same as active element 102 of the preferred embodiment. Thus, the components of active element 302 have the same number designations as those for active element 102. Hence, the descriptions that relate to active element 102 of the preferred embodiment are equally applicable to active element 302 and such descriptions are incorporated here by reference.

The preferred embodiment's further embodiment of the active element, which is active element 250 that is shown in FIG. 6, may also be used in the second embodiment of the smoking article of the invention. Accordingly, the descriptions that relate to active element 250 of the preferred embodiment are equally applicable here and are incorporated by reference.

Again referring to FIG. 8, reusable body 304 will be described. Reusable body 304 comprises holder 310, connector member 320, mouthpiece section 324 with tipping overwrap 326, and ejector section 328 with overwrap 330.

Elongated, hollow, cylindrical holder 310, preferably, is formed from heat resistant plastic. However, it may be formed also by conventional spiral winding techniques used for winding paper/foil laminate structures into tubes.

Connector member 320 is secured in, and extends from, the end of holder 310 that is intended to receive active element 302. The closed end of connector member 320 has orifice 322 disposed therethrough. Orifice 322 serves the same purpose as orifice 170 in connector 168 in the preferred embodiment. Therefore, the descriptions set forth above regarding orifice 170 are applicable to orifice 322 and are incorporated here by reference.

Connector member 320 does not have to be a separate element secured within holder 310, as shown in FIG. 8. A suitable connector can be the end of holder 310 necked-down to the desired diameter. In this configuration, a cap containing orifice 322 can be fixed onto the end of the necked-down portion of holder 310. It is contemplated also that the end of the necked-down portion can remain open and a separate member that includes orifice 322 be disposed within holder 310 transverse to the longitudinal axis, spaced away from the necked-down portion.

Connector member 320 also can be secured in, and extended from, the end of active element 302. In this configuration, the end of connector member 320 shown in FIG. 8, adjacent the inside diameter of holder 310, is detachably fixed therein, while the end adjacent laminate tube 112 is permanently fixed thereto. Further, either end of the connector may be closed with a cap or other structure that contains orifice 322.

Mouthpiece section 324 is a hollow, cylindrical member that is disposed over the second end of holder 310. Mouthpiece section 324 extends approximately one-half (½) the longitudinal length of holder 310. The inside diameter of mouthpiece section 324 is secured to the outside diameter of holder 310. Tipping wrap 326 is secured to the outside surface of mouthpiece section 324. Mouthpiece section 324 is conventionally constructed from laminate paper strips that are spiral wound into a tubular member of desired dimensions and cut to the desired length.

Ejector section 328 is a hollow, cylindrical member that extends from the end of mouthpiece section 324 midway along the longitudinal length of holder 310 to the first end of holder 310 (that is intended to receive active element 302). Ejector section 328 is covered with overwrap 330. The length of ejector section 328 is approximately one-half (½) the longitudinal length of holder 310. Ejector section 328 with overwrap 330 is translatable over holder 310 for ejecting spent active elements. Ejector section 328, like mouthpiece section 324, is conventionally constructed from laminate paper strips that are spiral wound into a tubular member of desired dimensions and cut to the desired length.

Figure 9:
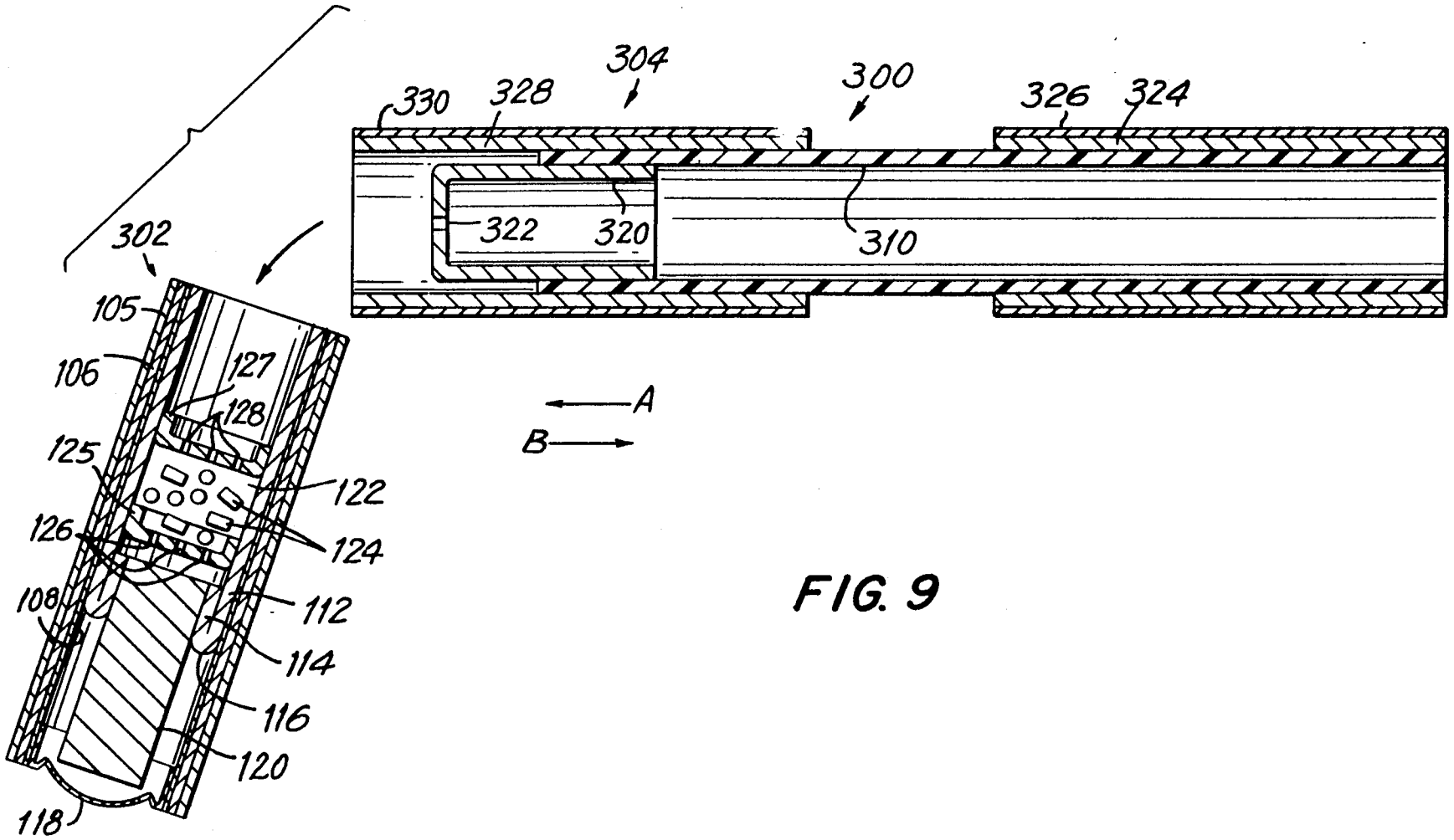
FIG. 9 shows the method of ejecting the active element from the reusable body in the second embodiment of the smoking article of the present invention.

Referring to FIGS. 8 and 9, the method of ejecting active element 302 from reusable body 304 will be described. After heat source 120 is spent, the smoker usually desires to discard active element 302 so that it can be replaced with a new one. Smoking article 300 with spent active element 302 would appear as shown in FIG. 8, except that portions of the heat source would have turned to ash.

To replace the spent active element, the smoker may grasp mouthpiece section 324 with tipping wrap 326 in one hand and ejector section 328 with overwrap 330 in the other. The smoker would then push ejector section 328 in direction "A" in FIG. 9. As this is done, the end of ejector section 328 pushes the adjacent end of active element 302 in the same direction. The active element is pushed in that direction until it is moved from over connector member 320. When active element 302 is unseated, it falls away from reusable body 304 as shown in FIG. 9. After the active element is ejected, ejector section 328 is moved in direction "B" in FIG. 9 back to its original position. The reusable body is ready to receive another active element. As in the preferred embodiment, the ejector section can be reset by the next active element being detachably fixed to the reusable body.

Figure 10:
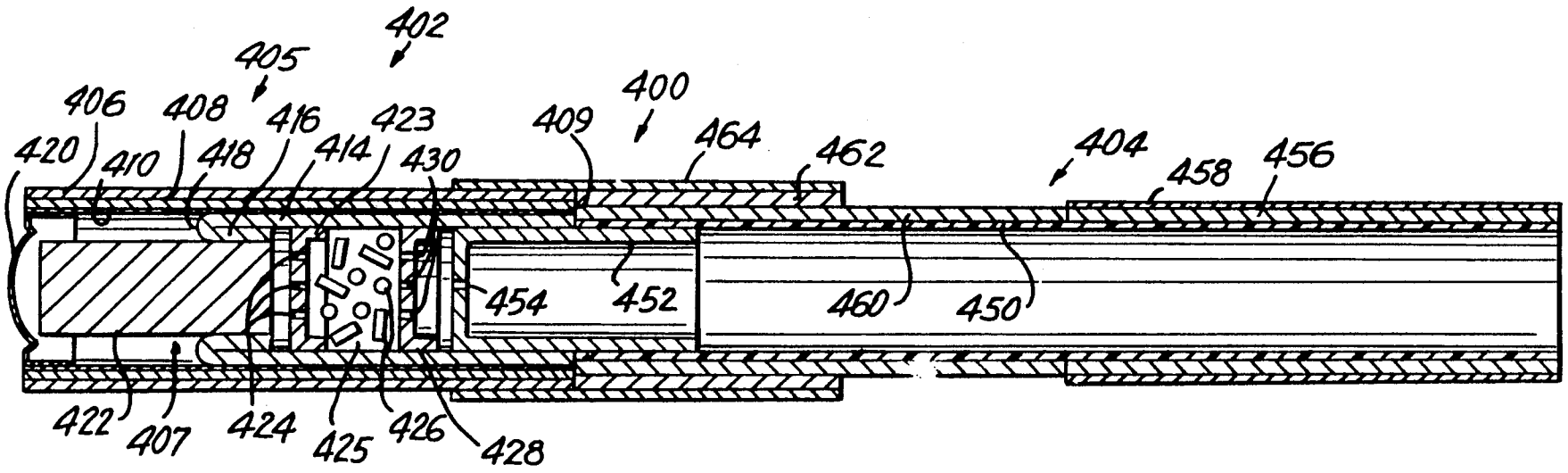
FIG. 10 is a cross-sectional view of the third embodiment of the smoking article of the present invention.
Figure 11:
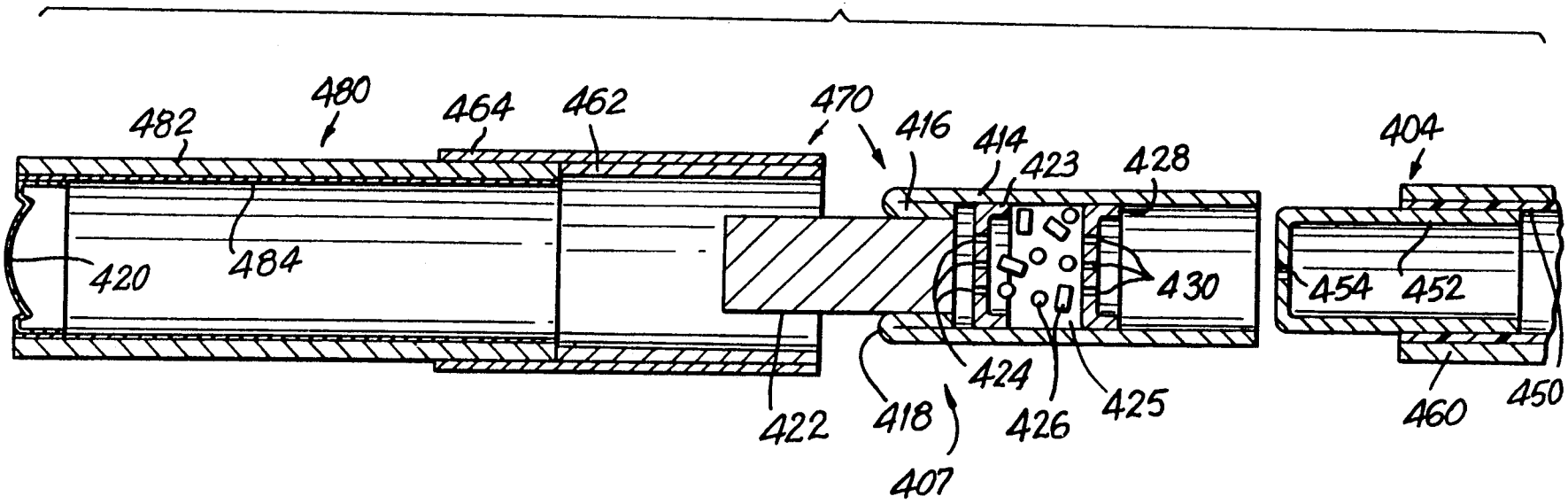
FIG. 11 is an exploded, cross-sectional view of the third embodiment of the smoking article of the present invention which includes a further embodiment of the removable cover.
Figure 12:
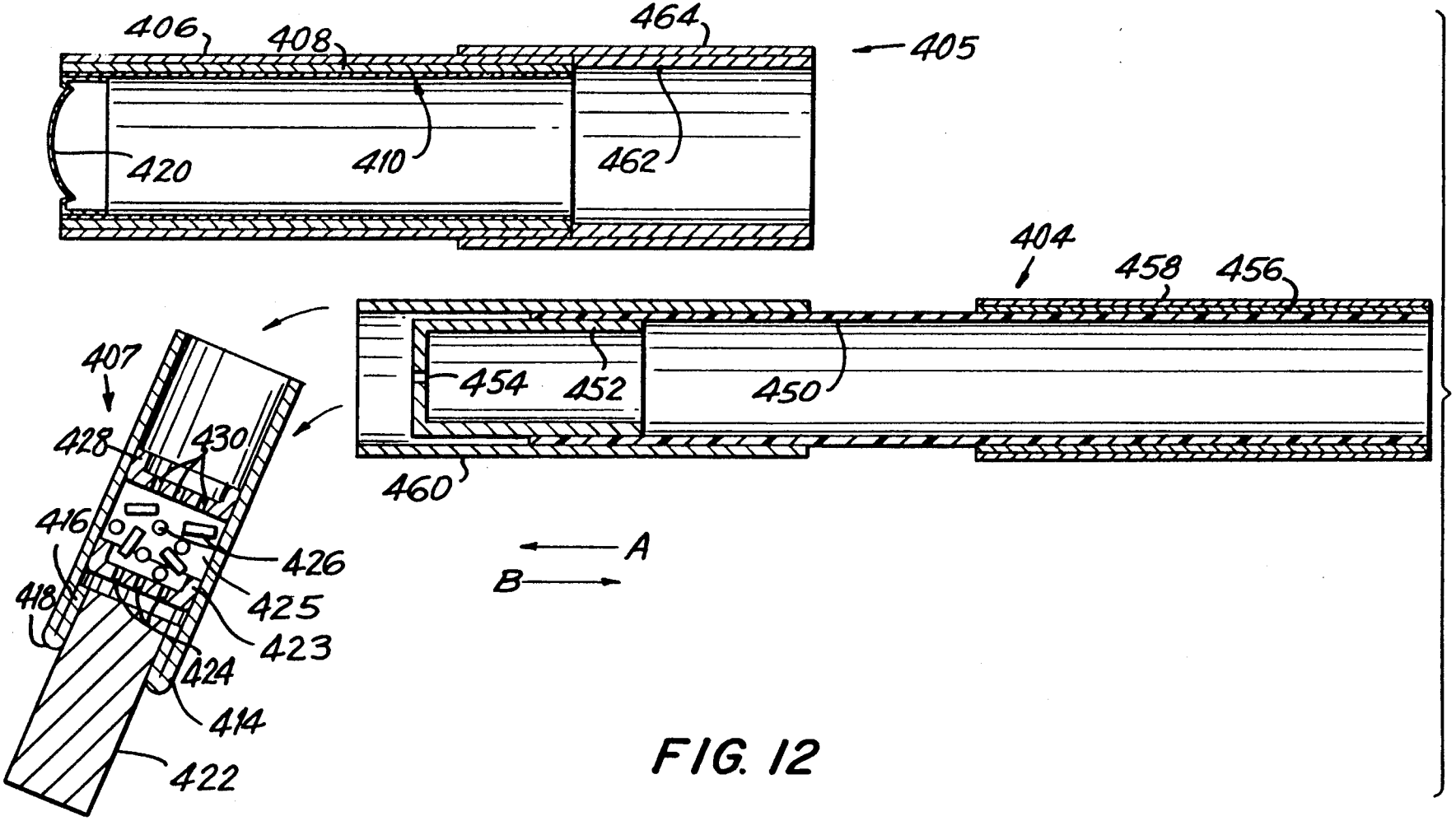
FIG. 12 shows the method of removing the removable cover and ejecting the disposable heat source and tobacco flavor producing elements from the reusable body of the third embodiment of the smoking article of the present invention.

FIGS. 10, 11 and 12 are directed to the third embodiment of the smoking article of the present invention. FIG. 10 shows smoking article 400 assembled. FIG. 11 shows a further embodiment of the active element of smoking article 400. FIG. 12 shows the heat source and tobacco flavor producing elements being ejected from the reusable body of smoking article 400 after removal of the removable cover.

Referring to FIG. 10, active element 402 is not a single front end structure like active element 102 in the preferred embodiment, but two separate parts: removable cover 405 and disposable section 407. Except for active element 402 comprising two separate parts and the addition of paper tube 462 and overwrap 464, it is the same as active element 102 of the preferred embodiment.

Removable cover 405 includes the combination of treated outer wrap 406 and treated inner wrap 408, perforated foil 410, end cap 420, paper tube 462, and overwrap 464. The construction and characteristics of treated outer wrap 406, treated inner wrap 408, perforated foil 410, and end cap 420 are the same as described for their counterparts in the preferred embodiment of the smoking article, viz., treated outer wrap 105, treated inner wrap 106, perforated foil 108, and end cap 118. Accordingly, the descriptions with respect to the like structures in the preferred embodiment also apply here and such descriptions are incorporated by reference.

The removable cover also includes paper tube 462 and overwrap 464. The paper tube abuts the second end of the combination of outer wrap 406 and inner wrap 408, and perforated foil 410. The paper tube has a wall thickness less than that of the combination. As best seen in FIG. 12, annular ledge 409 is formed between the combination and the paper tube.

Overwrap 464 covers paper tube 462 and a portion of the outside diameter of outer wrap 406. The overwrap connects the combination of outer wrap 406 and inner wrap 408, and perforated foil 410, with paper tube 462 to form removable cover 405.

Paper tube 462 has a longitudinal length shorter than that of ejector section 460. The reason the paper tube is shorter will be discussed subsequently.

Disposable section 407 includes laminate tube 414 with turned-in end 416 and end lip 418, heat source 422, first circular wall 423 with plurality of holes 424, chamber 425 containing tobacco pellets 426, and second circular wall 428 with plurality of holes 430. The structures that form disposable section 407 are of the same construction and possess the same characteristics as their counterparts in the preferred embodiment. Hence, the descriptions with respect to the laminate tube 112 with turned-in end 114 and end lip 116, heat source 120, first circular wall 125 with plurality of holes 126, chamber 122 containing tobacco pellets 124, and circular wall 127 with plurality of holes 128 of the preferred embodiment also apply here and such descriptions are incorporated by reference.

Reusable body 404 comprises holder 450, connector member 452 with orifice 454, mouthpiece section 456 with tipping wrap 458, and ejector section 460. Holder 450 has the same construction as holder 310 of the second embodiment. Hence, the descriptions regarding the construction and characteristics of holder 310 apply equally to holder 450. The descriptions with respect to holder 310 are incorporated here by reference.

Connector member 452 is secured in, and extends from, the end of holder 450 that is intended to receive active element 402. Connector member 452 has orifice 454 disposed through it for the same purpose as described for orifice 170 in connector member 168 of the preferred embodiment. Moreover, like the connector member in the second embodiment, connector member 452 can be formed by necking-down the end of the holder. In such a configuration, the open end of the connector member has a separate member that includes orifice 454 disposed across it. Further, the end of the connector member can remain open and a separate member that includes orifice 454 can be disposed within holder 450 spaced away from the necked-down portion.

As in the second embodiment, connector member 452 can be secured in the end of active element 402. When secured in this manner, the end of connector member 452 disposed adjacent the inside diameter of holder 450 is detachably fixed therein, while the end adjacent laminate tube 414 is permanently fixed thereto.

Mouthpiece section 456, like mouthpiece section 324 in the second embodiment, is a hollow, cylindrical member that extends from the second end of holder 450 (opposite the one from which connector member 452 extends) at the outside diameter of the holder. It extends approximately one-half (½) the longitudinal length of holder 450. The inside diameter of mouthpiece section 456 is secured to the outside diameter of holder 450. Tipping wrap 458 is secured to the outside surface of mouthpiece section 456. Mouthpiece section 456 is conventionally constructed from laminate paper strips that are spiral wound into a tubular member of the desired dimensions and cut to the desired length.

Ejector section 460, like ejector section 328 of the second embodiment, is a hollow, cylindrical member that extends from the forward end of mouthpiece section 456 disposed midway along the longitudinal length of holder 450 to the first end holder 450 at the outside diameter of the holder. The length of ejector section 460 is approximately one-half (½) the longitudinal length of holder 450. Ejector section 460 is translatable over holder 450. Ejector section 460, like ejector section 328 of the second embodiment, is conventionally constructed from laminate paper strips that are spiral wound into a tubular member of the desired dimensions and cut to the desired length.

Paper tube 462 has a longitudinal length approximately one-half (½) that of ejector section 460. When smoking article 400 is assembled (see FIG. 10), ejector section 460 is translated in direction "B" (FIG. 12) such that its second end abuts the first end of mouthpiece section 456. Removable cover 405 is disposed over disposable section 407 and a portion of ejector section 460. Moreover, as assembled, annular ledge 409 acts as a stop for the first end of ejector section 460. Since the paper tube is only one-half (½) the length of the ejector section when the smoking article is assembled, the half of the ejector section nearest the second is exposed. This half of the ejector section is exposed to facilitate removal of removable cover 405 before ejecting a spent disposable section 407, as will be discussed in greater detail subsequently.

FIG. 11, shows a cross-sectional view of the end of reusable body 404 and the separate parts of a further embodiment of the active element in spaced relationship. The second ends of laminate tube 414 (of disposable section 407) and paper tube 462 (of removable cover 480) are larger than the outside diameter of connector member 452. Accordingly, laminate tube 414 is disposed over connector member 452 and contacts the ends of holder 450 and ejector section 460, and the paper tube 462 is disposed over a portion of the ejector section.

Removable cover 480 includes ceramic member 482 with perforated foil 484 at the inside diameter and end cap 420. Ceramic member 482 and perforated foil 484 have the same construction and characteristics as ceramic member 252 and perforated foil 254 of the preferred embodiment. Hence, the descriptions for those structures of the preferred embodiment equally apply here and are incorporated by reference.

Referring to FIGS. 10 and 12, the method of ejecting spent disposable section 407 from reusable body 404 will be described. After heat source 422 is spent, the smoker usually desires to discard it so that it can be replaced with a new one. Smoking article 400 with spent disposable section 407 would appear as shown in FIG. 10 except portions of the heat source would have turned to ash.

The smoker may grasp the exposed portion of ejector section 460 with a finger and the thumb of one hand and the adjacent portion removable cover 405 comprising paper tube 462 with combining wrap 462 with finger thumb of the other. The smoker then pulls the removable cover in direction "A" in FIG. 12 while holding ejector section 460 in position, thereby removing it from over disposable section 407 and the front portion of ejector section 460. The smoker now grasps mouthpiece section 456 with tipping wrap 458 with the fingers and thumb of one hand and ejector section 460 with overwrap 464 with the fingers and thumb of the other. The smoker then pushes the ejector section in direction "A" in FIG. 12. As this is done, the end of ejector section 460 engages the adjacent end of laminate tube 414 and pushes disposable section 407 in the same direction. Disposable section 407 is pushed in that direction until it is moved from over connector member 452. The disposable section then falls away from reusable body 404.

After the disposable section is ejected, ejector section 460 is moved in direction "B" in FIG. 12 back to its original position. A new disposable section is then placed over connector member 452 with its second end abutting the first end of ejector section 460.

This is followed by disposing removable cover 405 over disposable section 407 and a portion of ejector section 460. The reassembled smoking article 400 is again ready for use. The ejector section also can be reset to its original position by detachably fixing the new disposable section to the reusable body.

Figure 13:
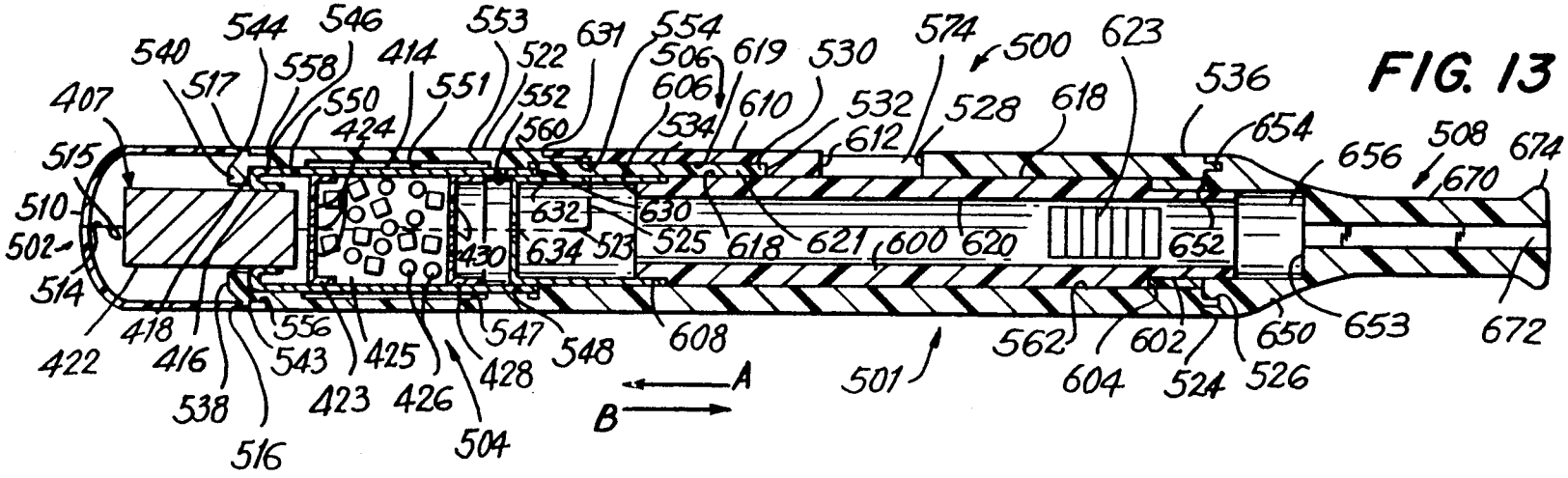
FIG. 13 is a cross-sectional view of the fourth embodiment of the smoking article of the present invention.
Figure 14:
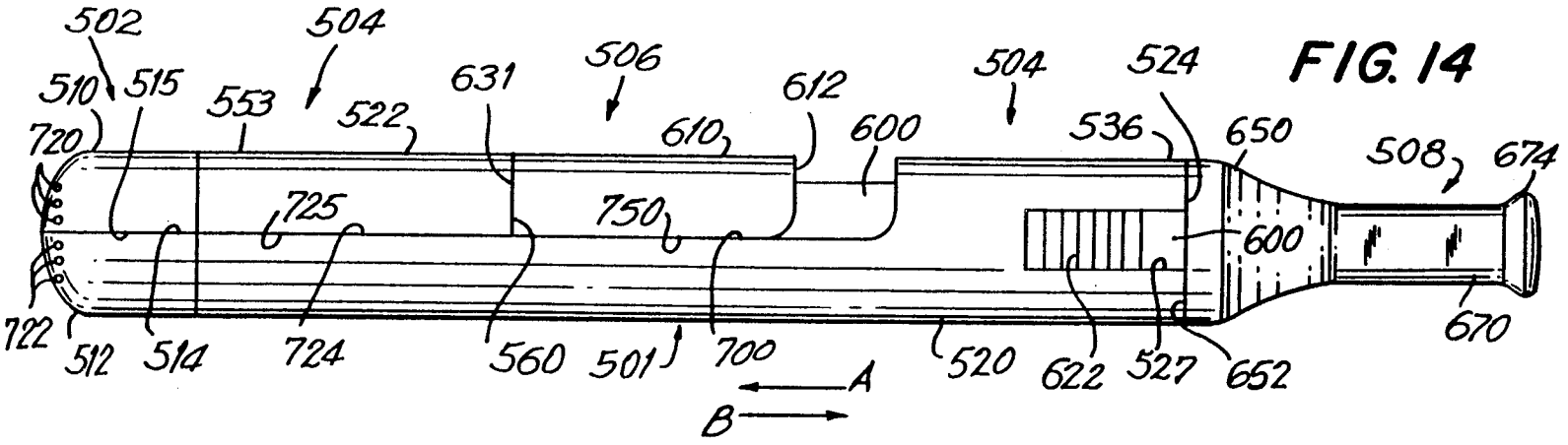
FIG. 14 is a side plan view of the fourth embodiment of the smoking article of the present invention.
Figure 15:
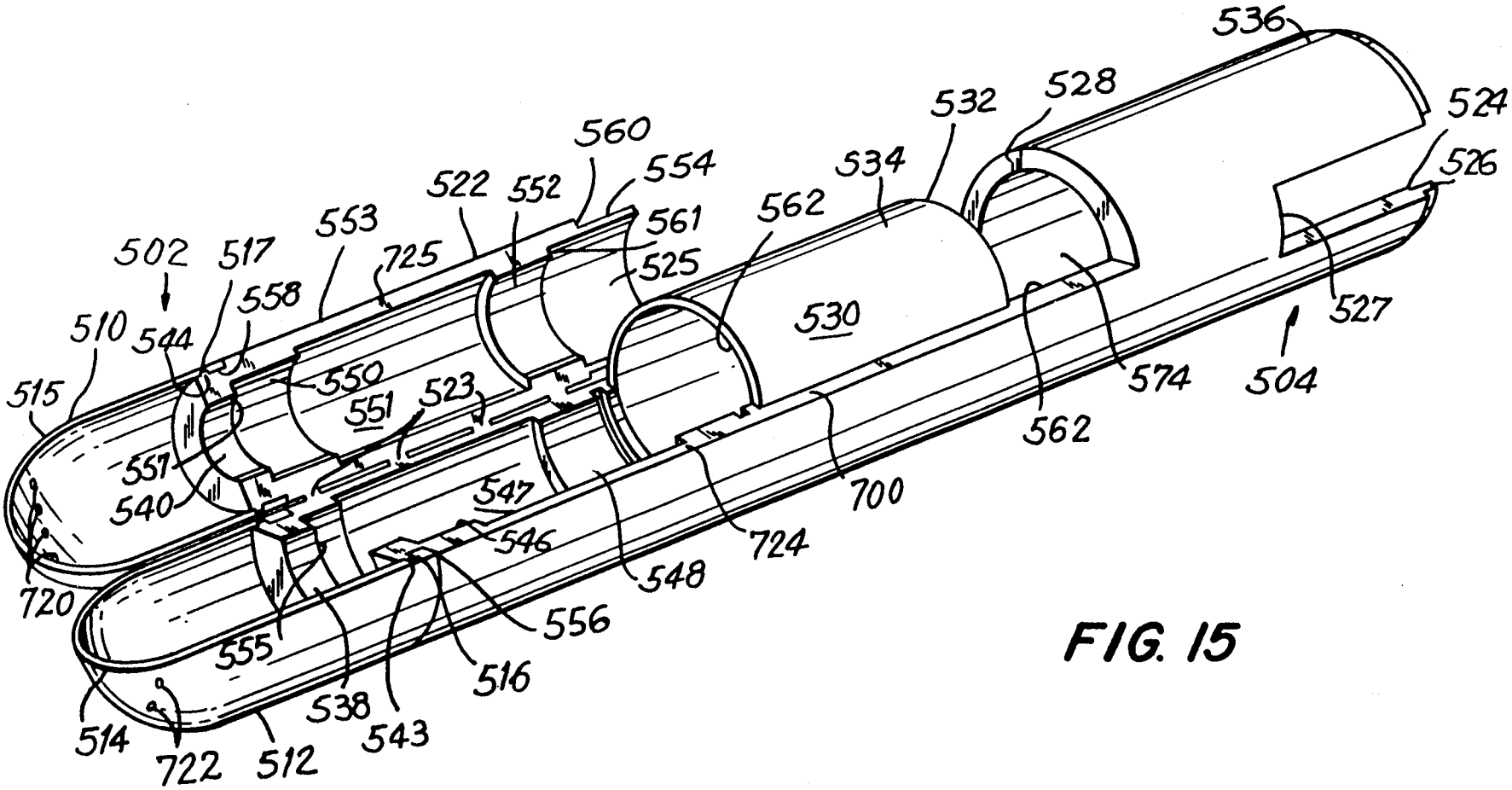
FIG. 15 is a elevated perspective view of the central body section with attached end cap halves of the fourth embodiment of the smoking article of the present invention.
Figure 16:
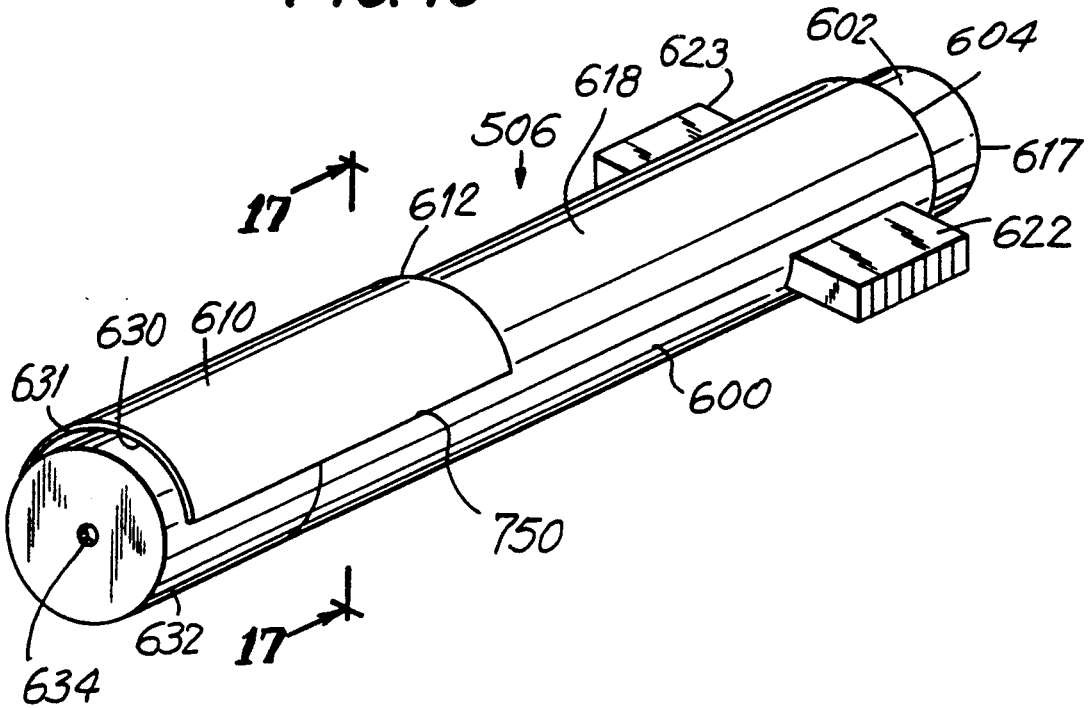
FIG. 16 is an elevated perspective view of the locking section of the fourth embodiment of the smoking article of the present invention.
Figure 17:
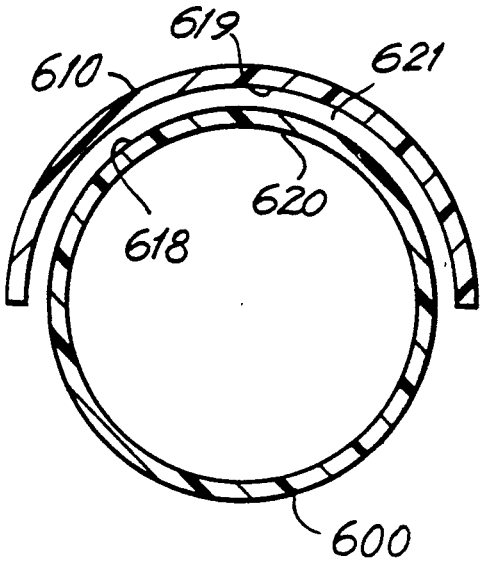
FIG. 17 is a cross-sectional view of the locking section of the fourth embodiment of the smoking article of the present invention along 17—17 of FIG. 16.
Figure 18:
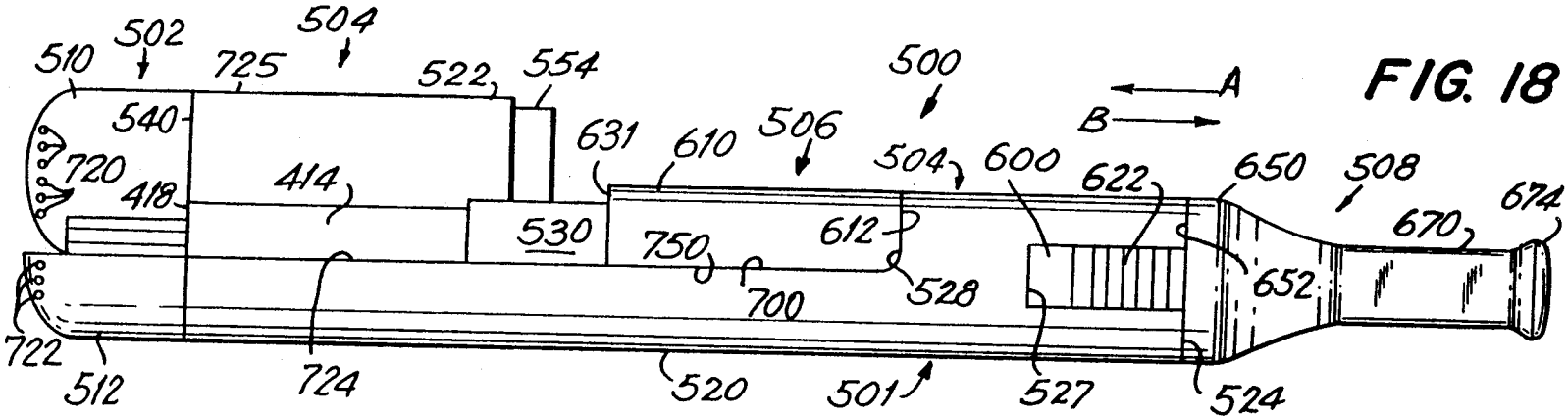
FIG. 18 is a side perspective view of the fourth embodiment of the smoking article of the present invention with the hinged segment and attached end cap half in the open position exposing the active element.
Figure 19:
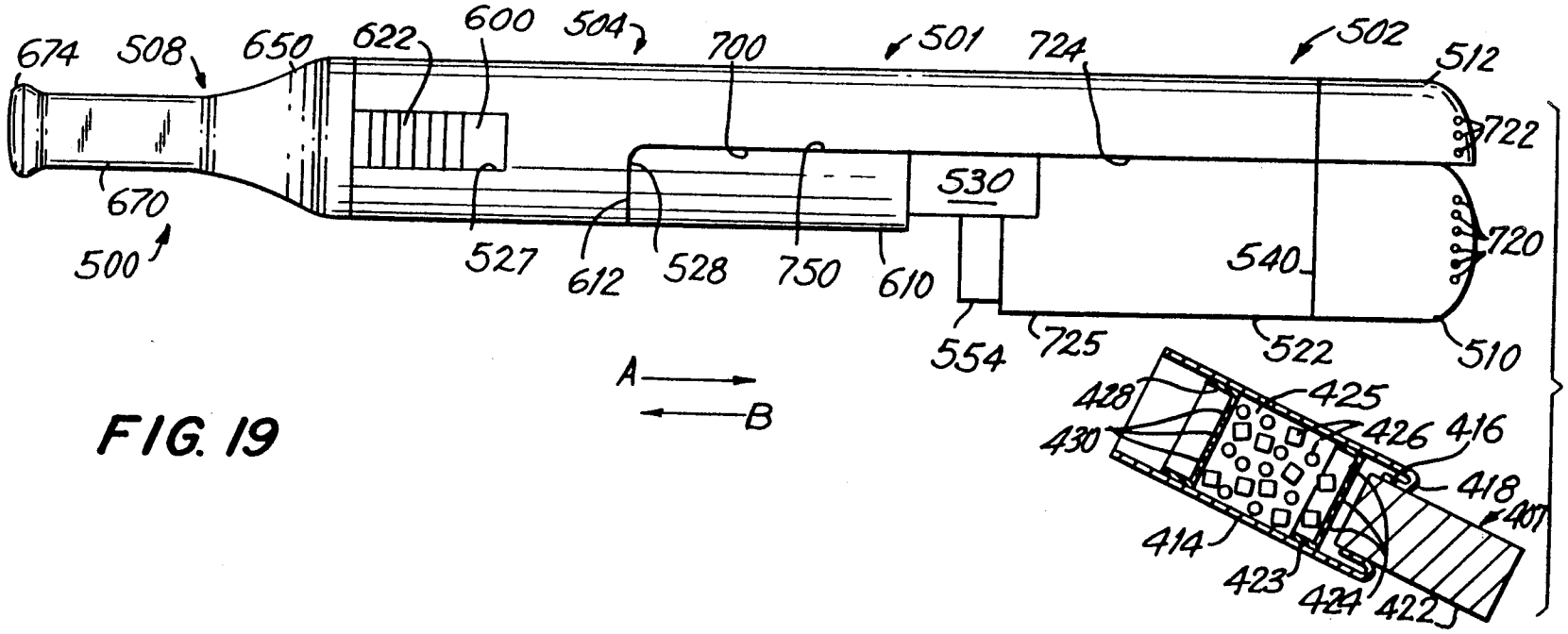
FIG. 19 shows the method of ejecting the active element from the reusable body of the fourth embodiment of the smoking article of the present invention.

FIGS. 13–19 are directed to a fourth embodiment of the smoking article of the present invention. FIG. 13 and 14 show, respectively, a cross-sectional and a side plan view of smoking article 500. FIG. 15 shows the central body section with the attached end cap. FIGS. 16 and 17 show views of the locking section of smoking article 500. FIG. 18 shows the hinged segment with the attached end cap of smoking article 500 open exposing the active element. FIG. 19 shows the active element being ejected from the reusable body of smoking article 500.

Referring to FIGS. 13–17, smoking article 500 includes active element 407 and reusable body 501. Active element 407 includes laminate tube 414 with turned-in end 416 and end lip 418, heat source 422, first circular wall 423 with holes 424, chamber 425 containing tobacco pellets 426, and second circular wall 428 with plurality of holes 430. The active element in this fourth embodiment comprises the same structures as those which comprise disposable section 407 of the third embodiment. Accordingly, like structures of the active element of the fourth embodiment have the same reference numbers as those of the disposable section of the third embodiment. Such like the structures of disposable section 407 of the third embodiment (that form the active element of the fourth embodiment) are of the same construction and possess the same characteristics as their counterparts in the preferred embodiment. Hence, the descriptions with respect to laminate tube 112 with turned-in end 114 and end lip 116, heat source 120, first circular wall 125 with plurality of holes 126, chamber 122 containing tobacco pellets 124, and second circular wall 127 with plurality of holes 128 of the preferred embodiment also apply here and those descriptions are incorporated by reference.

Reusable body 501 comprises two-piece end cap 502, central body section 504, locking section 506, and mouthpiece section 508. The construction and characteristics of these sections will now be described.

Central body section 504 is the main section of reusable body 501. Central body section 504 is best shown in FIG. 15. The central body section is formed from a suitable high temperature plastic. The central body section is a hollow, cylindrical member with a uniform inside diameter. It has cut-out 574 in a portion of the center one-third (⅓) and opposing slots in second end 524 (only slot 527 is shown) which receive the gripping members of locking section 506 therethrough. Locking section 506 also has a portion that extends through cut-out 574, as will be described. Connecting flange 526 extends from second end 524 and is used for connecting second end 524 of the central body section 504 to exterior annular ledge 652 of mouthpiece section 508.

The first one-third (⅓) of central body section 504 (at the first end of the central body section) includes hinged segment 522. The remainder of the central body section is referred to herein as the main segment. That is, the main segment comprises all portions of the central body section except the hinged segment. Hinged segment 522 is connected to the main segment by living hinge 523. The first end of central body 504 section, which includes a portion of hinged segment 522 and a portion of the main segment, is adapted to receive the end cap halves and, when the smoking article is assembled, is adapted to secure active element 407 within reusable body 501, as shown in FIGS. 13 and 18.

The center one-third (⅓) of central body section 504, as shown in FIG. 15, comprises hemispherical part 530 and opening 574. Hemispherical part 530 has a wall thickness less than that of the last one-third (⅓) of central body section 504. The differences in wall thickness is shown in FIG. 13 by comparing the cross-sectional wall thickness of hemispherical part 530 and the wall thickness of the last on-third (⅓) at 536. Because of the reduced wall thickness of the hemispherical part 530, longitudinal ledge 700 is formed along the length of hemispherical part 530. The use of ledge 700 will be described subsequently.

The last one-third (⅓) of central body section 504 (at the second end of the central body section) has a uniform outside diameter and opposing slots disposed in the end. This forms the second of the central body section.

The first one-third (⅓) of the central body section 504 comprises hinged segment 522 and the opposing portion of the main segment forward of the hemispherical part 530. The outside half diameters of these portions will be described first and then the inside half diameters will be described.

The outside half diameter of the main segment opposing the hinged segment is substantially uniform and is the same as the half-diameter below hemispherical part 530. The area of the main segment near the first end of central body section 504 is adapted to receive an end cap half. To facilitate disposition of the end cap half, the first end of the main segment has annular groove 556 spaced back from it. Annular bead 543 is adjacent annular groove 556 toward the first end. The portion of the outside half diameter formed by annular bead 543 is slightly less than that formed by the main segment adjacent annular groove 556.

The outside half diameter of hinged segment 522 has two steps plus an area near the first end of central body section 504 that is adapted to receive an end cap half. The two steps are end region 554 and elongated center region 553. Elongated center region 553 has an outside half diameter equal to that of the main segment disposed below it. End region 554 has an outside half diameter less than that of the center region. Hemispherical ledge 560 is formed between end region 554 and center region 553.

Like the first end of the main segment, the first end of hinged segment 522 has annular groove 558 that is spaced back from it and facilitates disposition of an end cup half. Adjacent annular groove 558, toward the first end, is annular bead 544.

The portion of the outside half diameter formed by annular bead 544 is slightly less than that of the center region. When hinged segment 522 is in the closed position adjacent the main segment, annular grooves 556 and 558, and annular beads 543 and 544, of the main segment and the hinged segment, respectively, are aligned.

The inside half diameters of the main segment and the hinged segment, which are opposite each other when the hinged segment is in the closed position, are substantially the same except that the hinged segment includes a portion associated with end region 554 for which the main segment does not have a corresponding section. Accordingly, the inside half diameter of the hinged segment will be described referring to the appropriate reference numbers and the reference numbers for like sections of the main segment will be indicated in parenthesis following the hinged segment reference numbers. The inside half diameter of hinged segment 522 will be described starting at end segment 554 and proceeding forward to the first end of central body section 504.

Hinged segment 522 has a stepped inside half diameter. The first step at end section 554 has a first half diameter. Second step 552 (548), which has a longitudinal length approximately the same as that of the first step, has a second half diameter slightly less than that of the first step. Hemispherical ledge 561 is formed between the first and second steps. Elongated third step 551 (547), which has a longitudinal length 3–4 times longer than the second step 552 (548), has the first half diameter. Fourth step 550 (546), which has a longitudinal length that is approximately equal to that of second step 552 (548), has the second half diameter. Fifth step 540 (538), which has a short longitudinal length, has a half diameter that is less than the second half diameter. Hemispherical ledge 557 (555) is formed between the fourth and fifth steps.

When hinged segment 522 is in the closed position, as shown in FIGS. 13 and 14, the inside half-diameters of hinged segment 522 and the opposing portions of the main segment secure active element 407 within smoking article 500. A best shown in FIG. 13, second steps 548 and 552, and fourth steps 546 and 550, contact the outside surface of laminate tube 414. Hemispherical ledges 555 and 557 are adjacent end lip 418 to prevent further forward movement of active element 407.

Referring to FIGS. 13, 14, and 15, end cap 502 will be described. End cap 502 Comprises two halves, 510 and 512. End cap half 510 is connected to hinged segment 522 and end cap half 512 is connected to the main segment portion that is opposite the hinged segment when in the closed position.

End cap halves 510 and 512 are preferably constructed of high temperature plastic. The inside surfaces of the end cap halves are reflective to keep the heat generated by heat source 422 within the end cap. The end cap halves can also be constructed of ceramic material, stainless steel, aluminum or other material that will provide the desired properties.

The ends of the hinged segment and main segment that receive the end cap halves are substantially the same, and the areas of the end cap halves that are received by these segments are substantially the same. Accordingly, attachment of end cap 510 to hinged segment 522 will be described referring to the appropriate reference numbers, and the reference numbers for the like sections of end cap half 512 and the main segment will follow in parenthesis.

Spaced away from the second end of end cap half 510 (512) is hemispherical groove 517 (516). When end cap half 510 (512) is fixed to the end of hinged segment 522 (main segment), the hemispherical strip at the second end of end cap half 510 (512) is received in hemispherical groove 558 (556) of hinged segment 522 (main segment) and hemispherical bead 544 (543) at end of the hinged segment is received in hemispherical groove 517 (516) of the end cap half. When the end cap is fixed to the hinged segment in this manner, the outside half diameter of the combination is uniform.

The first end of end cap half 510 (512) is closed in such a manner that it lies in the same plane as edge 515 (514) of the remainder of end cap half 510 (512). The first end of end cap 510 (512) has six or more equally spaced openings therethrough which form an arc. These openings are for the ingress of air to promote burning of the heat source.

When hinged segment 522 is in the closed position, as shown in FIGS. 13 and 14, edges 514 and 515 of end caps 510 and 512, respectively, fit tightly together to prevent any ash formed during burning of the heat source from falling from the smoking article regardless of the smoking article's orientation.

FIGS. 13, 16 and 17 show views of locking section 506. FIG. 13 shows a longitudinal cross-sectional view, FIG. 16 shows an elevated perspective view, and FIG. 17 shows a cross-sectional view perpendicular to the longitudinal axis.

Locking section 506 comprises tubular body 600 having opposing gripping members 622 and 623 disposed radially outward therefrom, mouthpiece engaging member 602 at the second end, and hemispherical lock member 610 disposed from the outside diameter near the first end. Locking section 506 is preferably constructed from a high temperature plastic.

Tubular body 600 has a uniform inside diameter and a stepped outside diameter. Starting from the second end of tubular body 600 which connects to mouthpiece section 508, the stepped outside diameter will be described. First step 617 at mouthpiece engaging member 602 has a first diameter which is slightly less than the inside diameter of the mouthpiece section that receives it. Elongated second step 618 has an second diameter which is greater than the diameter at the first step but less than the diameter at 562 of the inside diameter of central body section 504. Third step 608, at the first end of tubular body 600, has a diameter less than the second diameter but greater than the first diameter.

Locking section 506 can be constructed as a single piece unit or as a two piece unit. If it is a single piece unit, the main segment of central body section comprises two pieces. As such, the main segment will be divided into two pieces along longitudinally extending lines of separation in opposing walls. Locking section 506 and central body section 504 are slidably connected by separating the two pieces of the main segment and positioning the locking section between them. The two main segment pieces are then fixed together, for example, by sonic welding.

If locking section 506 is a two piece unit, it will consist of tubular body 600 and hemispherical lock member 610. The main segment in this situation is a single piece. The locking section and main segment are slidably connected by sliding tubular body 600 into the main segment through the second end to the proper position. Then, hemispherical lock member 610 is fixed to the outside diameter of tubular body 600 in the position shown in FIGS. 13 and 16.

Connector member 632 is a short, hollow, cylindrical member with one closed end. Connector member 632 is constructed of aluminum or a non-thermally degradable plastic. Its inside diameter is slightly larger than the diameter at third step 608. The open end of connector member 632 is disposed on, and secured to, third step 608 with the edge of its open end abutting the annular ledge formed between second step 618 and third step 608. The difference in diameter between second step 618 and third step 608 at the outside diameter is the same as the wall thickness of connector member 632. Hence, when connector member 632 is disposed on third step 608, its outside diameter is the same as second step 618.

The closed end of connector member 632 has orifice 634 disposed therethrough. Orifice 634 has the same purpose as orifice 170 in connector member 168 of the preferred embodiment. Accordingly, the descriptions with respect to orifice 170 are applicable here also and are incorporated by reference.

In an alternative configuration of the fourth embodiment of the smoking article, connector member 632 is not a separate member secured to third step 608 of tubular body 600. In this configuration, there is no third step at first end 606, but first end 606 extends as far as the end of connector member 632, as shown in FIG. 13. Moreover, the extension has the outside diameter equal to second step 618 and an inside diameter equal to the inside diameter of tubular body 600 at 620. It is contemplated also that a separate member that includes orifice 634 may be disposed within tubular body 600 transverse to the longitudinal axis, spaced away from first end 606 of the tubular body.

In a further alternative embodiment of the fourth embodiment of the smoking article, connector member 632 is secured in, but spaced away from, the second end of laminate tube 414 of active element 407. In this configuration, first end 606 of tubular body 600 has a continuous outside diameter that does not include first step 608.

Opposingly disposed gripping members 622 (FIGS. 14 and 16) and 623 (FIG. 16) extend radially outward from second step 618 at the outside diameter near the second end of tubular body 600. The gripping members fit into the opposingly disposed slots in the second end of central body section 504. The height of the gripping members in the outward radial direction is sufficient as long as each gripping member extends outward of the outside diameter of central body section 504 in its respective slot. The top surfaces of the gripping members have a sawtooth pattern on them to facilitate non-slip engagement.

Hemispherical lock member 610 has a hemispherical shaped transverse cross-section (FIGS. 13 and 14) and a "L" shaped longitudinal cross-section (FIG. 13). The hemispherical lock member is disposed from tubular body 600 at a position that is approximately one-third ($\frac{1}{3}$) the longitudinal length of the tubular body from the first end. When so disposed, hemispherical ledge 612 and hemispherical opening 621 (between the outside diameter of tubular body 600 with attached connector member 632 and the inside stepped diameter of hemispherical lock member 610) are formed.

The inside stepped diameter of hemispherical lock member 610 Comprises first step 619, which has a diameter greater than the outside diameter of tubular body 600, and second step 630, which has a diameter greater than that of the first step. The difference in diameter between the outside diameter of tubular body 600 at 618 and the inside diameter of hemispherical lock member 610 at 619 is the wall thickness of hemispherical part 530. Further, the difference in diameter between the outside diameter of tubular body 600 at 618 and the inside diameter of hemispherical lock member 610 at 630 is the combined wall thickness of hemispherical part 530 and end region 554 of hinged segment 522.

Referring to FIGS. 13, 14, and 18, locking section 506 fits within central body section 504. When so disposed, gripping members 622 and 623 of the locking section extend through respective slots in the central body section, and hemispherical lock member 610 extending through opening 574 in the central body section. When these two sections are engaged as described, hemispherical part 530 of the central body section is received in hemispherical opening 621 that is formed between the outside diameter of tubular body 600 at 618 with attached connector member 632 and the inside stepped diameter of hemispherical lock member 610. Edge 750 of hemispherical lock member 610 is disposed a adjacent longitudinal ledge 700 of central body section 504. Ledge 750 rides on ledge 700 when locking section 506 is translated in directions "A" and "B" for locking hinged segment 522 in the closed position or releasing it to open to the open position.

Referring to FIGS. 13 and 14, smoking article 500 is shown with hinged segment 522 of central body section 504 in the closed position. In the closed position, locking section 506 is translated in direction "A". In the closed position, second step 630 at the inside diameter of hemispherical lock member 610 is disposed over the outside diameter of end region 554 of hinged segment 522. This locks hinged segment 522 tightly in place. Moreover, in the closed position, edge 631 of hemispherical lock member 610 abuts hemispherical ledge 560 of hinged segment 522. Edge 532 of hemispherical part 530, which engages the base of hemispherical opening 621, and the forward ends of the slots, which receive gripping members 622 and 623, act as stops for translation of locking section 506 in direction "A."

Referring to FIGS. 18 and 19, smoking article 500 is shown with hinged segment 522 in the open position. In the open position, locking section 506 is translated in direction "B". When the locking section is translated as described, edge 528 of opening 574 and exterior annular ledge 652 of mouthpiece section 508, which forms the rearward end of the slots that receive the gripping members, act as stops for translation of locking section 506 in direction "B".

When locking section 506 is translated in direction "B", second step 630 at the inside diameter of lock member 610 is moved from over end region 554 of hinged segment 522. This releases hinged segment 522 and living hinge 523 moves hinged segment 522 to the open position.

As in the preferred embodiment, the outside diameter of connector member 632 is slightly less than the inside diameter at the second end of laminate tube 414 so that they can fit together in an interference fit. When locking section 506 is translated in direction "A", locking hinged segment 522 in the closed position, connecting member 632 is disposed in the second end of laminate tube 414 of active element 407. Conversely, when locking section 506 is translated in direction "B", releasing hinged segment 522 to open to the open position, connecting member 632 is retracted from within the second end of laminate tube 414 of active element 407.

Referring to FIGS. 13 and 14, mouthpiece section 508 is detachably fixed to second end 524 of central body section 504. Specifically, annular connecting flange 526, which extends from second end 524 of central body section 504, is fixed in annular groove 654 in exterior annular ledge 652 of mouthpiece section 508. Further, the two step opening in the mouthpiece section is engaged by the mouthpiece engaging member 602 of locking section 506.

Mouthpiece section 508 tapers from a circular cross-section at 650, which is equal in diameter to the outside diameter of central body section 504 at second end 524, to a rectangular cross-section at second end 674 of the mouthpiece section. The exterior of the mouthpiece section adjacent second end 674 widens slightly to facilitate being held in the mouth of the smoker.

The two-part opening within mouthpiece section 508 comprises cylindrical opening 656, which extends from the first end into the mouthpiece section a predetermined distance toward second end 674, and rectangular opening 672, which extends through the remainder of the mouthpiece section to second end 674. Rectangular opening 672 is similar to the rectangular opening 186 in mouthpiece section 184 of the preferred embodiment shown in FIGS. 1 and 2. Hence, the descriptions relating to rectangular opening 186 are incorporated by reference. If the smoker desires, a replaceable plug wrap covered cellulose acetate filter may be disposed in cylindrical opening 656 against interior annular ledge 653.

As stated, the mouthpiece section 508 has an exterior that tapers from a circular shape to a rectangular shape, and the interior has a two-part opening. It is contemplated also that the mouthpiece section can have other interior and exterior shapes and still within the scope of the present invention. For example, mouthpiece section 508 can comprise a hollow, cylindrical member. This member can have an outside diameter equal to the diameter at 536 of second end 524 of central body section 504. The opening through this further embodiment of the mouthpiece section can be stepped, as in the preferred embodiment, or a single diameter. In either case, however, if desired, a replaceable filter can be disposed in the opening of this further embodiment of the mouthpiece section.

Referring to FIGS. 13, 14, 18, and 19, the method of ejecting active element 407 from reusable body 501 will be described. After heat source 422 is spent, the smoker usually desires to discard it so it can be replaced with a new active element. Smoking article 500 with spent active element 407 would appear as shown in FIG. 13 except portions of the heat source would have turned to ash.

To replace spent active element 407, the smoker may grasp central body section 506 near second end 524 with the fingers and thumb of one hand and would place a finger and the thumb of the other hand on gripping members 622 and 623 of locking section 506, respectively. The smoker would then pull the gripping members, and, thereby move or slide the locking section, in direction "B". Gripping members 622 and 623 are moved in direction "B" until hemispherical ledge 612 of lock member 610 contacts edge 528 of opening 574 in central body section 506, and the gripping members contact exterior annular ledge 652 of mouthpiece section 508. As this is done, connecting member 632 is retracted from within the second end of laminate tube 414 of active element 407 and first step 630 at the inside diameter of lock member 610 is moved from over end region 554 of hinged segment 522. This releases hinged segment 522.

Once hinged segment 522 is released, living hinge 523 moves hinged segment 522 to the open position shown in FIG. 18. After the hinged segment is in the open position, active element 407 is ejected from reusable body 501 by turning the smoking article over and allowing the spent active element to fall from reusable body 501 by the force of gravity, as shown in FIG. 19.

Following ejection of the spent active element, reusable body 501 is ready to receive a new active element. This is accomplished by turning the reusable body back over and then placing a new active element 407 in central body section 506 in the portion of the main segment adjacent hinged segment 522. When this is done, the smoking article will have the appearance as shown in FIG. 18.

Once the new active element is placed in the main segment, end lip 418 is adjacent hemispherical ledge 555 formed between the fourth and fifth steps of the inside diameter of the main segment. After active element 407 is properly disposed as described, the smoker moves hinged segment 522 to the closed position with the fingers and thumb of one hand and holds it there. With a finger and the thumb of the other hand, the smoker moves gripping members 622 and 623 in direction "A" until the base of hemispherical opening 621 contacts edge 532 of hemispherical part 530, and gripping members 622 and 623 contact the front ends of their respective slots. This locks hinged segment 522 in the closed position and smoking article 500 is ready for use.

Further embodiments of the second and third embodiments of the present invention include a cellulose acetate filter wrapped in plug wrap disposed in the end of the holder having the mouthpiece section.

In other embodiments of the preferred, second, and third embodiments of the present invention, there is not a connector member for joining the active element and reusable body. In a first case, the end of the active element that connects to the reusable body has an inside diameter slightly larger than the outside diameter of the end of the reusable body. Hence, in assembling the smoking article the end of the active element fits over the end of the reusable body. In the second case, the end of the reusable body has an inside diameter slightly larger than the outside diameter of the end of the active element. Hence, in assembling the smoking article, the end of the active element fits into the end of the reusable body. In each case, the parts are secured by an interference fit.

The terms and expressions which are employed herein are used as terms of expression and not of limitation. And, there is no intention, in the use of such terms and expressions, of excluding the equivalents of the features shown and described, or portions thereof, it being recognized that various modifications are possible in the scope of the invention.

We claim:

1. A smoking article comprising:

(a) an active element having a first end and a second end, the active element further comprises, (1) a hollow, cylindrical sleeve having inner and outer diameter walls, with the inner diameter wall having means to secure a combustible heat source within the sleeve at a position along the longitudinal length of the sleeve, and with the active element being air permeable near the first end of the active element, (2) the combustible heat source having a predetermined longitudinal length and being secured within the sleeve, with the combustible heat source having means for effecting fluid communications along its longitudinal length, and (3) a flavor producing means disposed adjacent to, but spaced away from, an end of the combustible heat source, with the flavor producing means being reactive to radiative and convective heat transferred to it from the combustible heat source; and (b) a hollow, cylindrical body having a first end and second end, with the first end of the body being adapted for detachably fixing thereto the second end of the active element, and with the body including ejector means to facilitate detachment of at least the combustible heat source and flavor producing means from the body by translating the ejector means with respect to the body a predetermined distance in the longitudinal direction with respect to the body toward the active element until at least the combustible heat source and flavor producing means are disengaged from the body and attachment of at least a new combustible heat source and a flavor producing means to the body by translating the ejector means back to its original position through the predetermined distance and away from the active element after engaging at least the new combustible heat source and flavor producing means.

2. The article as recited in claim 1 wherein, the active element is a single unit.

3. The articles as recited in claim 2 wherein, the active element further comprises a first portion and a second portion of the sleeve, and a main air permeable means disposed across the first end of the active element.

4. The article as recited in claim 1 wherein, the active element comprises a removable cover means and a disposable means.

5. The article as recited in claim 4 wherein, the removable cover means further comprises a first portion of the sleeve and a main, air permeable means disposed across the first end of the active element.

6. The article as recited in claim 3 or 5 wherein, the first portion of the sleeve includes a porous ceramic tube with perforated foil disposed at the inside diameter.

7. The article as recited in claim 6, wherein the porous ceramic material with perforated foil combination is air permeable.

8. The article as recited in claim 3 or 5 wherein, the first portion of the sleeve includes outer and inner tubular members fixed together, with the inner member having perforated foil disposed at the inside diameter, and with the inner and outer tubular members being treated with flame retardant material.

9. The article as recited in claim 8, wherein the combination of the inner and outer tubular members, and perforated foil is air permeable.

10. The article as recited in claim 3 or 5 wherein, the main air permeable means disposed across the first end of the active member includes an end cap with a predetermined number of holes therethrough of a predetermined diameter.

11. The article as recited in claim 4 wherein, the disposable means includes a second portion of the sleeve, the carbon heat source, and the flavor producing means.

12. The article as recited in claim 3 or 11 wherein, the second portion of the sleeve includes a laminate tubular structure that is disposed within the first portion of the sleeve, with a first end of the second portion of the sleeve being adapted to secure therein the combustible heat source.

13. The article as recited in claim 1 wherein, first closure means with at least one hole therethrough that is disposed across the inside diameter of the hollow, cylindrical sleeve, a second closure means with at least one hole therethrough that is disposed across the inside diameter of the hollow, cylindrical sleeve spaced away from the first closure means, and an inner diameter wall of the hollow, cylindrical sleeve form a chamber within the sleeve for receiving the flavor producing means.

14. The article as recited in claim 1 wherein, the means for effecting fluid communications through the combustible heat source is a passageway having a predetermined cross-sectional shape.

15. The article as recited in claim 1 wherein, the flavor producing means includes tobacco pellets.

16. The article as recited in claim 1 wherein, connector means connects the active element and the body, the connector means including a cylindrical member disposed from the first end of the body having an outside diameter slightly less than the inside diameter of the second end of the active element.

17. The article as recited in claim 1 wherein, connector means detachably fixes the first end of the body to the second end of the active element.

18. The article as recited in claim 17 wherein, the connector means includes a cylindrical member disposed from the first end of the body with the connector means having an outside diameter slightly less than the inside diameter of the second end of the active member.

19. The article as recited in claim 17 wherein, connector means includes a cylindrical member disposed from the second end of the active element, with the connector means having an outside diameter slightly less than the inside diameter of the first end of the body.

20. The article as recited in claim 17 wherein, a transverse member with a metering orifice therethrough is disposed across an end of the connector means in a plane perpendicular to the longitudinal axis of the article.

21. The article as recited in claim 1 wherein, a transverse member with a metering orifice therethrough is disposed across the inside diameter of the body in a plane perpendicular to the longitudinal axis of the article.

22. The article as recited in claim 1 wherein, a traverse member with a metering orifice therethrough is disposed across the inside diameter of the active element near the second end in a plane perpendicular to the longitudinal axis of the article.

23. The article as recited in claim 1 wherein, the body includes a mouthpiece section which forms the outside shape of the body near the second end.

24. The article as recited in claim 22 wherein, the mouthpiece section extends from the second end of the body to an intermediate point along the longitudinal length of the body.

25. The article as recited in claim 1 wherein, a mouthpiece section forms the second end of the body.

26. The article as recited in claim 1 wherein, the ejector means is translatable in the longitudinal direction with respect to the body, with an end of the ejector means forming a movable first end of the body that is disposed adjacent to at least a portion of the second end of the active element.

27. The article as recited in claim 1 wherein, the body is elongated.

28. The article as recited in claim 1 wherein, a filter means is disposed within the body.

29. The article as recited in claim 28 wherein, the filter means is a cellulose acetate filter.

30. A smoking article comprising:

(a) an active element having a first end and a second end, the active element further comprises,
  (1) a non-combustible hollow, cylindrical member, with the member having means to secure a combustible heat source therein,
  (2) the combustible heat source having a predetermined longitudinal length and being secured within the hollow, cylindrical member, with the carbon heat source having means for effecting fluid communications along its longitudinal length, and
  (3) a flavor producing means disposed adjacent, but spaced away from, an end of the combustible heat source that is reactive to radiative and convective heat transferred to it from the combustible heat source; and (b) a hollow, cylindrical body having a first end and second end, with the first end of the body being air permeable and adapted for detachably fixing therein the active element, and with the body further comprising a hinged segment moveable between an open and a closed position and a locking segment translatable over a predetermined distance in the longitudinal direction with respect to the body such that when the locking segment is translated in the direction of the second end of the body, the hinged segment is in the open position and the active element is detached from the first end of the body and a new active element is attached to the first end of the body, and when the locking segment is translated in the direction of the first end of the body, the hinged segment is in the closed position.

31. The article as recited in claim 30 wherein, a living hinge connects the hinged segment to a remainder of the body and moves the hinged segment to the open position when the hinged segment is released.

32. The article as recited in claim 30 wherein, the first end of this body is air permeable.

33. The article as recited in claim 34 wherein, the first end of the body has a predetermined number of holes therethrough for the ingress of air into the first end to facilitate burning of the carbon heat source.

34. The article as recited in claim 30 wherein, the non-combustible hollow, cylindrical member includes a laminate tubular structure having an outside diameter slightly less than the inside diameter of the first end of the body adapted to secure active element therein.

35. The article as recited in claim 30 wherein, first closure means with at least one hole therethrough that is disposed across the inside diameter of the hollow, cylindrical sleeve, a second closure means with at least one hole therethrough that is disposed across the inside diameter of the hollow, cylindrical sleeve spaced away from the first closure means, and the end of the combustible heat source secured by the hollow, cylindrical member form a chamber within the sleeve for receiving the flavor producing means.

36. The article as recited in claim 30 wherein, the means for effecting fluid communications through the carbon heat source is a passageway having a predetermined cross-sectional shape.

37. The article as recited in claim 30 wherein, the flavor producing means includes tobacco pellets.

38. The article as recited in claim 30 wherein, connector means detachably engages the active element within the body, the connector means includes a cylindrical member disposed from means capable of locking and releasing the hinged segment that is part of the body.

39. The article as recited in claim 38 wherein, a transverse member with a metering orifice therethrough is disposed across an end of the connector means in a plane perpendicular to the longitudinal axis through the article.

40. The article as recited in claim 30 wherein, a transverse member with a metering orifice therethrough is disposed across the inside diameter of the body in a plane perpendicular to the longitudinal axis through the article.

41. The article as recited in claim 30 wherein, in the mouthpiece section forms the second end of the body.

42. The article as recited in claim 30 wherein, the body is elongated.

43. The article as recited in claim 30 wherein, a filter means is disposed near the second end of the body.

44. The article as recited in claim 43 wherein, the filter means is a cellulose acetate filter.

* * * * *